US005286371A

United States Patent [19]

Goval et al.

[11] Patent Number: 5,286,371

[45] Date of Patent: Feb. 15, 1994

[54] PROCESS FOR PRODUCING NEEDLE COKE

[75] Inventors: Shri K. Goval, Naperville, Ill.; Jeffrey J. Kolstad, Wayzata, Minn.; F. W. Hauschildt, Geneva, Ill.; Dean G. Venardos, Batavia, Ill.; Cheryl L. M. Joval, Evanston, Ill.

[73] Assignee: Amoco Corporation, Chicago, Ill.

[21] Appl. No.: 913,461

[22] Filed: Jul. 14, 1992

[51] Int. Cl.[5] ..... C10G 9/14; C10B 55/00

[52] U.S. Cl. ..... 208/131; 208/50; 208/87

[58] Field of Search ..... 208/50, 131, 51, 87, 208/89, 56, 57, 87, 131

[56] References Cited

U.S. PATENT DOCUMENTS 4,178,229 5/1978 McConaghy et al. ..... 208/50

5,013,427 7/1989 Mosby et al. ..... 208/87

*Primary Examiner*—David Brunsman

*Assistant Examiner*—Bekir L. Yildirim

*Attorney, Agent, or Firm*—Thomas A. Yassen; Richard A. Kretchmer

[57] ABSTRACT

A process is provided for producing premium and super premium grade needle coke comprising the steps of passing a heavy resid feedstock to a resid hydrotreating reaction zone at resid hydrotreating conditions and producing light resid hydrotreated products and a heavy resid hydrotreated residual product, directing the heavy resid hydrotreated residual product and FCC decanted oil to a solvent extraction process reaction zone at solvent extraction process conditions and producing products comprising a solvent extracted oil and resin stream and a stream comprising asphaltenes, and conveying at least a portion of the solvent extracted oil and resin stream to a delayed coking process at delayed coking conditions and producing liquid products and premium grade coke.

20 Claims, 2 Drawing Sheets

PROCESS FOR PRODUCING NEEDLE COKE

BACKGROUND OF THE INVENTION

This invention relates to a process for the manufacture of premium grade coke (needle coke) from petroleum-derived feedstocks. More particularly, this invention relates to a process for the production of needle coke from resid hydrotreated and deasphalted residual feedstocks and deasphalted fluid catalytic cracking unit (FCC) decanted oil (DCO) in a delayed coking process.

The delayed coking of conventional refinery residual components, generally having an atmospheric equivalent boiling point exceeding 1000° F. generally produces a coke having a longitudinal coefficient of thermal expansion (CTE) of about $20\times10^{-7}$/° C. or greater after graphitization. Graphitization generally refers to the process of exposing coke to high temperatures, generally ranging from about 2000° F. to about 3500° F., for the purpose of oxidizing or burning off impurities. Such impurities generally increase the CTE of the coke. The CTE of a graphitized coke is an important measure of its suitability for use in the manufacture of electrodes for electric arc steel furnaces. Electrode expansion attendant to high CTE coke can adversely change the arcing characteristics and performance of an arc furnace and can also be more susceptible to costly electrode breakage. For this reason, the steel industry standards for electric arc furnace electrodes generally require that the CTE be less than $8\times10^{-7}$/° C., often less than $5\times10-7$/° C, and for some services, less than $3\times10^{-7}$/° C.

Some steel producers have begun to monitor the "dynamic puffing" characteristics of needle coke and either require that needle coke meet particular dynamic puffing specifications or debit or credit the price they are willing to pay for the needle coke based on dynamic puffing characteristics. Coke produced from conventional refinery residual feedstock components generally tends to have undesirable dynamic puffing characteristics. It has been found that puffing is generally correlated to the presence of elements such as sulfur in the coke which can form impurity pockets and become fracture sites. The presence of fracture sites present in coke having poor puffing characteristics, can and generally does reduce electrode life. For this reason, some steel manufactures are requiring that the needle coke they purchase be "non-puffing" or "slightly puffing", as defined by laboratory procedures which measure the difference between the minimum and maximum deflection points of a plug produced from needle coke that is heated across an extended temperature range. For example, some manufacturers require that such plugs produced from needle coke reflect dynamic puffing levels of less than 7 percent, often less than 4 percent, and, for some services, less than 2 percent, measured as a percentage of the length of the plug. Coke produced from conventional refinery residual feedstock components having such undesirable puffing characteristics generally has a sulfur concentration ranging from about 2.0 percent by weight to about 4.0 percent by weight whereas sulfur concentrations typical of coke having suitable needle coke puffing characteristics, are generally less than 1.6 percent by weight and typically less than 1.0 percent by weight.

Needle coke has a particularly high market value and can be worth from about 5 to about 10 times the value of its feedstock components, depending on the quality of the needle coke. Conventional refinery grade coke is generally used only as fuel and is valued accordingly. Moreover, refinery fuel grade coke can be high in sulfur content, further reducing its value to industry as a boiler fuel due to environmental regulations controlling emissions of sulfur-derived combustion products. Some better quality conventional refinery grade cokes can be used for anodes in aluminum smelting processes. Such cokes are generally referred to as anode grade delayed coke. The market value of anode grade coke is substantially lower than the market value of needle coke. Therefore, there is a great need in the refining industry for flexible and reliable processes for producing needle coke or for upgrading existing conventional coking processes to needle coking processes.

Conventional delayed coking processes utilized for producing needle coke are generally known in the art. In the usual application of the delayed coking process, refinery residual components are heated in a coking furnace and directed to a coking drum. During the coking process, the residual feedstock is thermally decomposed to a heavy tar or pitch which further decomposes into solid coke and vapor products. The vapor components formed during decomposition are generally recovered in a fractionating column to products such as coker wet gas, coker naphtha, coker distillates, and coker gas oil. The solid coke is left behind in the coke drum.

Delayed coking processes generally function in a semi-continuous manner such that while one coke drum or battery of coke drums fills with a mass of solid coke, a second coke drum or battery of coke drums is being purged of vapors, cooled, opened for removal of the solid coke, and prepared for refilling. When the first coke drum or battery of coke drums is filled, coke drum feed is redirected to the second coke drum or battery of coke drums which has been emptied of solid coke and prepared for coke drum feedstock. The solid coke is generally removed from the coke drums by means such as hydraulic or mechanical drilling.

It is also known that delayed coking feedstocks for the production of needle coke generally include refinery streams such as thermal tars, untreated straight run FCC decanted oil provided directly from an FCC operating facility, pyrolysis tar, minor amounts of high and low sulfur virgin residual components, other compositionally similar materials, and mixtures thereof. Moreover, other processing steps have been utilized upstream of delayed coking processes for the production of needle coke, to modify such feedstocks in a manner so as to produce needle coke under delayed coking conditions.

For example, U.S. Pat. No. 4,502,944 to Kegler et al. discloses a process for producing needle coke from a residual oil feedstock derived from a naphthenic crude oil. The residual feedstock is subjected to a demetallization step, followed by desulfurization, and delayed coking.

U.S. Pat. No. 4,178,229 to McConaghy et al. discloses a process for producing needle coke from a residual oil feedstock derived from a hydrogen donor diluent cracking operation. A gas oil fraction derived from the hydrogen donor diluent cracking operation is recycled back to the hydrogen donor diluent cracking operation as the hydrogen donor diluent.

U.S. Pat. No. 4,894,144 to Newman et al. discloses a process for the simultaneous manufacture of both premium needle coke and aluminum grade coke wherein a virgin heavy oil is hydrotreated, separated into a light and heavy fraction, and each component separately subjected to delayed coking conditions. The light fraction is coked under delayed coking conditions to premium coke and the heavy fraction is coked under delayed coking conditions to aluminum grade coke.

The above processes generally provide limited process control options for meeting the CTE and puffing specifications for needle coke described above or require that specific feedstock source constraints, such as a naphthenic crude source or a low sulfur vacuum residue derived from low sulfur crude, be satisfied in order to produce needle coke. These constraints and this limited flexibility can result in substantial process penalties and higher operating risk.

The processing and treatment of FCC decanted oil has also been the focus of U.S. patents.

For example, U.S. Pat. No. 4,832,823 to Goyal discloses a delayed coking process wherein untreated FCC decanted oil is conveyed directly to a delayed coker along with high and low sulfur vacuum resid. The combination of untreated FCC decanted oil and high and low sulfur resid results in reduced yields of low value fuel grade coke.

An article by Todo, Oyama, Mochida, Korai, Abe, and Sakanishi entitled "Cocarbonization Properties of Solvent Deasphalted Oil from a Petroleum Vacuum Residue in Production of Needle Coke" discloses a study of the production of needle coke using a deasphalted low sulfur vacuum residue derived from low sulfur crudes and untreated straight run FCC decanted oil.

U.S. Pat. No. 4,427,531 to Dickakian discloses a process for converting FCC decanted oil to a feedstock for carbon artifact manufacture, and in particular, carbon fiber production. The FCC decanted oil is vacuum stripped, solvent extracted, and heat soaked to provide a feedstock suitable for carbon fiber manufacture.

Processes utilizing untreated FCC decanted oil often incur difficulty meeting CTE specifications due to the presence of solids and catalyst fines in the decanted oil. Periodic shutdown of an FCC for cyclone repairs or replacements in order to minimize decanted oil solids content is costly as are auxiliary equipment for separating and removing solids from decanted oil.

Integrating a resid hydrotreating process with a solvent extraction process for increasing the yield of light hydrocarbon products is also the subject of U.S. patents.

U.S. Pat. No. 5,013,427 to Mosby et al. discloses a resid hydrotreating process wherein the vacuum reduced resid hydrotreater residual product is directed to a solvent extraction process for extraction and separation of the residual product into solvent extracted oil, solvent extracted resins, and asphaltenes. The solvent extracted resins are recycled back to the resid hydrotreating process for increasing the yields of lower boiling, higher valued liquid products. The solvent extracted oil is directed to a FCC process directly or by way of a FCC gas oil feed hydrotreating process.

U.S. patent application Ser. No. 07/616,218, filed on Jul. 18, 1989 and allowed on Jan. 15, 1992, now U.S. Pat. No. 5,124,077, discloses a process for removing catalyst solids and fines from FCC decanted oil by mixing the decanted oil with a residual fraction and processing the mixture in a solvent extraction process. The deasphalted oil from the solvent extraction process can be directed to a resid hydrotreating process or to an FCC for cracking.

Such processes have historically been utilized as an alternative to delayed coking processes and have generally not been sequenced or integrated with delayed coking processes in general, and particularly delayed coking processes for the production of needle coke.

It is therefore an object of the present invention to provide an integrated delayed needle coking process that provides a mechanism for consistently meeting needle coke CTE specifications.

It is another object of the present invention to provide an integrated delayed needle coking process that provides a mechanism for consistently meeting needle coke dynamic puffing specifications.

It is another object of the present invention to provide an integrated delayed needle coking process that provides a mechanism for meeting needle coke CTE and dynamic puffing specifications with minimal resid quality limitations and without substantially constraining the crude selection process.

It is another object of the present invention to provide an integrated delayed coking process that provides maximum flexibility for accommodating needle coke specifications with alternative process embodiments.

Other objects appear herein.

SUMMARY OF THE INVENTION

The above objects can be obtained by providing a process for producing premium grade needle coke comprising the steps of passing a heavy resid feedstock to a resid hydrotreating reaction zone at resid hydrotreating conditions and producing light resid hydrotreated products and a heavy resid hydrotreated residual product, directing the heavy resid hydrotreated residual product and FCC decanted oil to a solvent extraction process reaction zone at solvent extraction process conditions and producing products comprising a solvent extracted oil and resin stream and a stream comprising asphaltenes, and conveying at least a portion of the solvent extracted oil and resin stream to a delayed coking process at delayed coking conditions and producing liquid products and premium grade coke.

In another embodiment, the above objects can be achieved by providing a process for producing premium grade needle coke comprising the steps of passing a heavy resid feedstock comprising one or more of high sulfur resid, low sulfur resid, FCC decanted oil, solvent extracted oil and resin, solvent extracted oil, solvent extracted resin, and lubricating oil solvent extraction process extracts to a resid hydrotreating reaction zone at resid hydrotreating conditions and producing light resid hydrotreated products and a heavy resid hydrotreated residual product; directing the heavy resid hydrotreated residual product and FCC decanted oil to a solvent extraction process reaction zone at solvent extraction process conditions and producing products comprising a solvent extracted oil stream, a solvent extracted resin stream, and a stream comprising asphaltenes; and conveying at least a portion of one or both of the solvent extracted oil stream and the solvent extracted resin stream to a delayed coking process at delayed coking conditions and producing liquid products and premium grade coke; wherein the FCC decanted oil is added to at least one or both of the resid hydrotreating reaction zone and the solvent extraction process zone in a manner so as to produce a premium grade coke having a coefficient of thermal expansion of less than about $5\times10^{-7}/°C$.

It has been found that integrating a resid hydrotreating process with a solvent extraction process and a delayed coking process for making premium grade coke in the manner described in the present invention provides a premium grade coke having a suitable CTE for the production of electrodes for electric arc steel furnaces. Moreover, the process of the present invention facilitates maximum CTE control, dynamic puffing control, crude mix independence, and process flexibility.

In particular, it has been found that optimal needle coke CTE control can be maintained by control of FCC decanted oil flowrate to the resid hydrotreating unit reaction zone and/or the solvent extraction unit reaction zone in a manner so as to control the concentration of aromatics in the delayed coker feed at a level of from about 30 percent by weight to about 95 percent by weight. Control of delayed coker feed aromatics in the manner described hereabove and in accordance with the present invention generally results in needle coke having a CTE of less than about $8\times10^{-7}/°C$. At the same time, the process of the present invention removes particulate contaminants from the FCC decanted oil that also cause high CTE characteristics.

It has also been found that optimal needle coke dynamic puffing characteristics can be maintained by controlling the recycle rate of solvent extraction unit oils and resins to the resid hydrotreating unit in a manner so as to maintain the sulfur concentration of the delayed coker feed below 1.6 percent by weight. It has also been found that the addition of a hydrotreating step to the oils and resins product leaving the solvent extraction process can provide additional needle coke dynamic puffing control and improve needle coke quality.

The integrated delayed needle coking process of the present invention provides a mechanism for consistently meeting needle coke CTE specifications. CTE characteristics can be optimized by any one of several mechanisms including adjustment of FCC decanted oil flowrate to the resid hydrotreating step, adjustment of the FCC decanted oil flow rate to the solvent extraction step downstream of the resid hydrotreating step, or by adjusting the mix of solvent extraction unit resins and oils in the delayed needle coker feedstock. CTE characteristics can also be optimized by adjusting the yield of solvent extraction unit resins and oils in the resid solvent extraction step.

The integrated delayed needle coking process of the present invention provides a mechanism for consistently and reliably meeting needle coke dynamic puffing specifications. Dynamic Puffing Specifications can be optimized and assured by adjusting the operating severity or catalyst activity of the resid hydrotreating process, adjustment of the recycle flowrate of the solvent extraction process oil or resin stream back to the resid hydrotreating process, or adjustment of the flowrate to or severity of a solvent extraction unit oils and resins hydrotreater downstream of the solvent extraction process.

The integrated delayed needle coking process of the present invention provides a mechanism for meeting needle coke CTE and dynamic puffing specifications with minimal resid quality limitations and without substantially constraining the crude selection process. The flexibility of the present invention with regard to meeting needle coke specifications permits the refiner to process substantially all types of crudes, whether these crudes are particularly low or high in sulfur content, low or high in API gravity, paraffinic or naphthenic, or high in metals.

The integrated delayed coking process of the present invention provides maximum flexibility for accommodating needle coke specifications with alternative process embodiments. In addition to providing a process for the efficient and reliable production of high quality needle coke, the present invention provides a strong process foundation for removing existing equipment from service while continuing to provide high quality needle coke. For example, the flexibility of the present invention permits a refiner to remove several operating systems from service for routine maintenance while having the backup systems in place to maintain operating efficiency.

BRIEF DESCRIPTION OF THE INVENTION

The present invention generally relates to a process for upgrading and increasing the value added to the lowest API gravity and generally highest boiling fractions of petroleum. Alternative dispositions for these materials are limited since such fractions generally have low market values. Such hydrocarbons are not easily upgraded or converted to products having higher market values since these materials often thermally or catalytically degrade to undesirable components that can foul processing facilities and deactivate catalysts.

Figure 1:
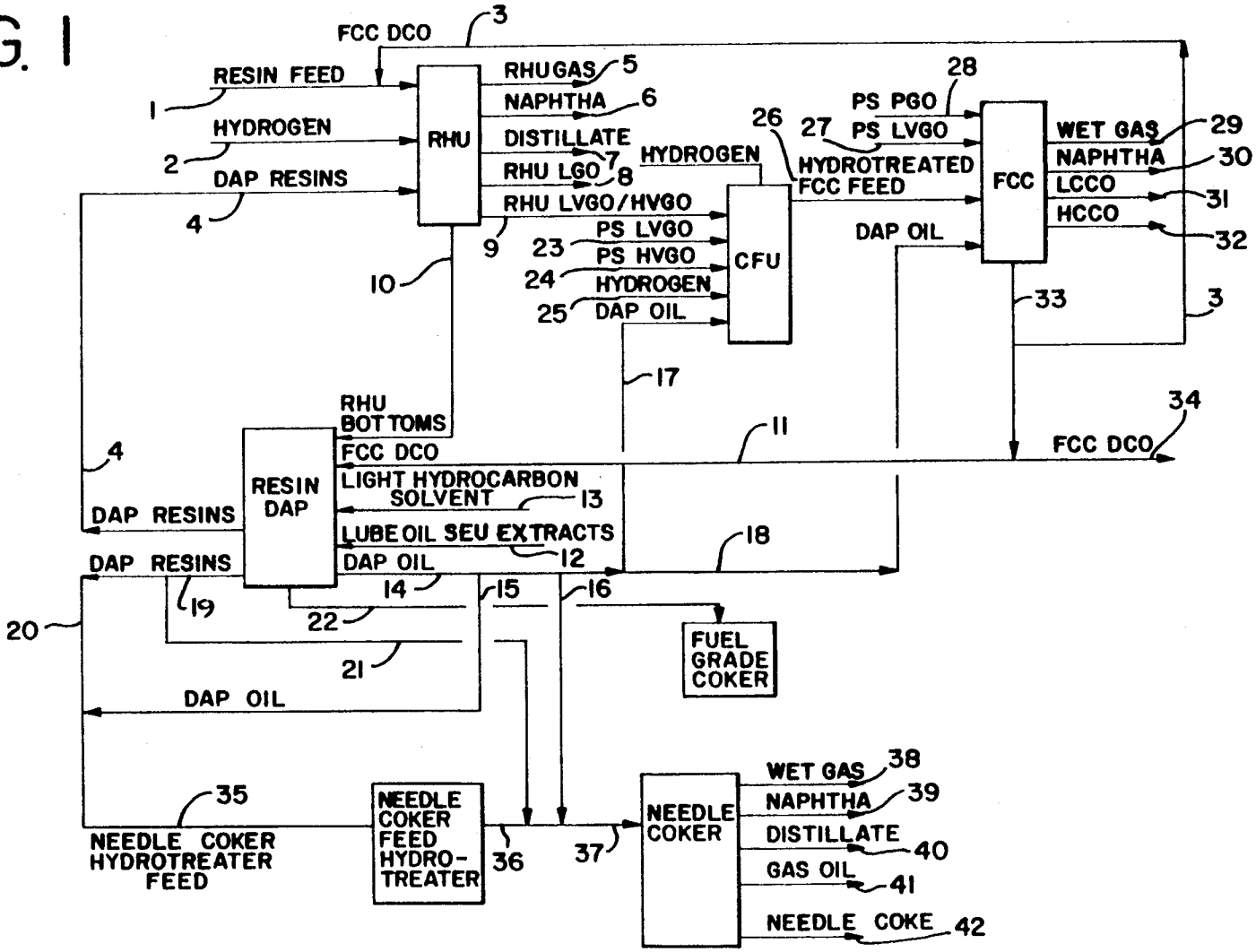
FIG. 1 is a process flow diagram of an integrated process for producing high quality needle coke in accordance with the present invention.

FIG. 1 illustrates an embodiment of an integrated needle coking process in accordance with the principles of the present invention. A residual feedstock, generally comprising one or more of residual boiling components derived from high and low sulfur crudes, decanted oils from FCC processes, lubricating oil extracts produced in lubricating oil solvent extraction processes (lubricating oil extracts), oils and resins produced in resid solvent extraction processes, and suitable substitutes is directed, through resid feedstock conduit 1, to a resid hydrotreating process (RHU). The feedstock from conduit 1 is processed in the presence of hydrogen from conduit 2 at resid hydrotreating conditions for the production of resid hydrotreated products. The resid feedstock 1 can also be supplemented by FCC decanted oil (FCC DCO) provided from recycle decanted oil conduit 3 and resid deasphalting process (DAP) resins provided from recycle DAP resins conduit 4, wherein such streams are recycled back to the resid hydrotreating process from a fluid catalytic cracking process and a resid solvent extraction process respectively.

The products of the resid hydrotreating process generally comprise light hydrocarbon gases (RHU gas) conveyed through conduit 5, naphtha comprising light naphtha, intermediate naphtha, heavy naphtha, and vacuum naphtha (RHU naphtha) conveyed through conduit 6, distillate comprising light distillate and middle distillate (RHU distillate) conveyed through conduit 7, light gas oil (RHU LGO) conveyed through conduit 8, light vacuum gas oil and heavy vacuum gas oil (RHU LVGO/HVGO) conveyed through conduit 9, and hydrotreated vacuum resid (RHU vacuum resid) conveyed through conduit 10.

The RHU gas from conduit 5 can be directed to hydrocarbon recovery and treatment processes for recovery and sale of chemical components and feedstocks such as propane and propylene or for internal refinery consumption such as furnace and boiler fuel and olefin alkylation. Light and intermediate naphthas from conduit 6 can be sent to a vapor recovery unit for further processing as a gasoline blending component or for directing to other downstream processing steps such as an isomerization process for the production of higher octane isoparaffins from generally pentane and hexane or a catalytic reforming process for the production of aromatics and hydrogen. Heavy naphtha from conduit 6 is generally directed to a catalytic reforming process for the production of aromatics and hydrogen. The distillate fraction from conduit 7 is generally a feedstock for the production of diesel fuel and furnace oil blending components or can be upgraded in catalytic conversion processes such as fluid catalytic cracking and catalytic hydrocracker processes. Light gas oil from conduit 8 is generally useful as a feedstock for an FCC and can be conveyed to an FCC directly and without preprocessing. Light and heavy vacuum gas oils from conduit 9 are also generally useful as a feedstock for an FCC but are generally directed to an FCC feed catalytic hydrotreating unit (CFU) prior to conveying to an FCC as illustrated in FIG. 1. RHU LVGO/HVGO is conveyed through conduit 9 to a CFU.

In the integrated delayed coking process of the present invention, the RHU vacuum resid from conduit 10 is directed to a deasphalter or deasphalting process (DAP) wherein the RHU vacuum resid is processed at deasphalting conditions and separated into deasphalted oil (DAP oil), deasphalted resins (DAP resins), and DAP asphaltenes (DAP asphaltenes). Supplemental feedstocks for processing in the deasphalting step include FCC DCO which is provided from conduit 11 and lubricating oil extracts which is provided from conduit 12. Where the DAP process is a resid solvent extraction deasphalting process, light hydrocarbon solvents, generally comprising one or more of propane, isobutane, normal butane, isopentane, normal pentane, hexane, and/or heptane can be required and are provided to the DAP process of FIG. 1 from conduit 13.

The DAP oil can be utilized, in some fraction and, with or without subsequent hydrotreating, as needle coker feed and/or FCC feed. In FIG. 1, DAP oil exits the DAP process through conduit 14 which branches into conduit 15 for directing to a needle coker hydrotreating step, conduit 16 for conveying directly to a needle coker, conduit 17 for directing to a CFU, and conduit 18 for conveying directly to an FCC.

The DAP resins can be utilized, in some fraction and, with or without subsequent hydrotreating, as needle coker feed or can be directed back to the resid hydrotreating step for RHU solids control or additional desulfurization. The DAP resins exit the DAP process through conduit 19 which branches into conduit 20 for conveying to a needle coker hydrotreating step and conduit 21 for conveying directly to a needle coker. DAP resins are recycled back to the RHU through conduit 4.

The DAP asphaltenes can be and are generally directed to a fuel grade coking process or for use as solid fuel for process furnaces and boilers. The DAP asphaltenes, in FIG. 1, are conveyed through conduit 22, to a coking process (fuel grade coker) for the production of fuel grade coke.

The RHU LVGO/HVGO streams from conduit 9, a fraction of the DAP oil stream from conduit 17, and any combination of vacuum gas oils from refinery high and low sulfur crude units, designated in FIG. 1 as PS LVGO from conduit 23 and PS HVGO from conduit 24, can be directed to an FCC feed catalytic hydrotreating process (CFU). The CFU facility processes this combined feedstock, in the presence of hydrogen from conduit 25, at FCC feed hydrotreating conditions, and results in the production of a higher quality FCC feedstock that can be upgraded at higher subsequent yields to a more valuable mix of products in an FCC process. This higher quality feedstock (hydrotreated FCC feed) is conveyed to the FCC process through conduit 26.

The hydrotreated FCC feed from conduit 26, a fraction of the DAP oil from conduit 18, and any combination of light vacuum and primary gas oils from refinery high and low sulfur crude units, designated in FIG. 1 as PS LVGO from conduit 27 and PS PGO from conduit 28, are directed to an FCC. The FCC facility processes this combined feedstock at fluid catalytic cracking conditions, and produces lighter, more valuable fluid catalytically cracked products including FCC wet gas (wet gas), FCC cracked naphtha (naphtha), light catalytic cycle oil (LCCO), heavy catalytic cycle oil (HCCO), and decanted oil (DCO).

FCC wet gas is generally directed to additional fractionation steps in a vapor recovery process wherein components of the wet gas can be further processed in processes such as olefin alkylation, polymerization, etherification for the production of oxygenates, and refinery fuel. The wet gas is conveyed to any or several of the above described process steps through conduit 29. The FCC cracked naphtha is generally directed to additional fractionation steps in a vapor recovery process wherein components of the naphtha can be directed to gasoline component blending, olefin alkylation, or to a catalytic reforming process for the production of aromatics and hydrogen. The naphtha is conveyed to any or several of the above described process steps or pools through conduit 30. The LCCO is generally utilized for feedstock for the production of diesel fuel or furnace oil blending components, although LCCO can also be hydrocracked to lower boiling hydrocarbons or recracked in an FCC. The LCCO is conveyed to any or several of the above described process steps or pools through conduit 31. The HCCO is generally utilized as a residual fuel blending component, as a feedstock for a hydrocracking process, or is recycled back to an FCC for recracking. The HCCO is conveyed to any of the above described process steps or pools through conduit 32. The decanted oil (DCO), also known as slurry oil, is the highly aromatic bottoms fraction from the FCC main fractionator and is generally utilized as a blending component for the production of residual fuels, as a solids control solvent for an RHU, as a resid solvent extraction process feedstock component for producing a needle coker feedstock for use in the present invention, and as refinery furnace and boiler fuel. The DCO from the FCC exits the FCC through conduit 33 where it branches into conduit 11 for feedstock to a DAP and then to a needle coking process, conduit 3 where it is recycled back to the resid hydrotreating process for use as a solids control solvent, and conduit 34 where it is directed to the residual fuel blending component pool.

DAP oil and DAP resins from conduits 15 and 20 respectively can be combined in feed conduit 35 for directing to a needle coker feed hydrotreating step wherein the DAP oil and DAP resins streams are hydrotreated in the presence of hydrogen at needle coker feed hydrotreating conditions to a needle coker feedstock having a lower concentration of sulfur. The lower sulfur concentration of the needle coker feedstock results in additional capability for meeting needle coke sulfur, nitrogen, and dynamic puffing specifications. The needle coker hydrotreater product is discharged through conduit 36 as hydrotreated needle coker feed.

The hydrotreated needle coker feed from conduit 36 is combined with fractions of unhydrotreated DAP oil and DAP resins from conduits 16 and 21 respectively, forming a delayed needle coker feedstock in conduit 37 for directing to a delayed needle coking process (needle coker). In this manner, the refiner has the flexibility to provide the optimal needle coker feedstock sulfur concentration for producing needle coke having the optimal concentration of sulfur and the optimal dynamic puffing characteristics, by controlling either the needle coker feed hydrotreater severity or by controlling the fraction of the DAP oil and DAP resins that is directed to the needle coker feed hydrotreater compared to the fraction routed to the needle coker directly.

The needle coker feed from conduit 37 is directed to the needle coker where it is processed at needle coking conditions for producing lighter coker products and coke (green coke) meeting the quality specifications of needle coke. The lighter products generally include coker wet gas (wet gas) discharged through conduit 38, coker cracked naphtha (naphtha) discharged through conduit 39, coke still distillate or coker distillate (distillate) discharged through conduit 40, and coker gas oil (gas oil) discharged through conduit 41. The needle coke is removed from a coke drum and is conveyed to needle coke consumers from coke transporting means which can comprise coke trucks which remove the needle coke from a coke yard 42.

The coker wet gas is generally directed to additional fractionation steps in a vapor recovery process wherein components of the wet gas can be further processed in processes such as olefin alkylation, polymerization, etherification for the production of oxygenates, and refinery fuel. Some wet gas components such as propylene and propane can be further refined and treated, and sold as chemical feedstock. The coker cracked naphtha is generally directed to additional fractionation steps in a vapor recovery process wherein components of the naphtha can be directed to gasoline component blending, olefin alkylation, or to a catalytic reforming process for the production of aromatics and hydrogen. The coker distillate is generally utilized for feedstock for the production of diesel fuel or furnace oil blending components, although coker distillate can also be hydrocracked to lower boiling hydrocarbons or recracked in an FCC. The coker gas oil is generally directed to an FCC hydrotreating process for upgrading prior to cracking in an FCC. The needle coke is generally mechanically removed from delayed coking drums to a coke yard for transport to consumers.

The feedstocks suitable for upgrading in the initial resid hydrotreating step of the process of the present invention generally include, but are not limited to, residual boiling components derived from high and low sulfur crudes, decanted oils from FCC processes, lubricating oil extracts produced in lubricating oil solvent extraction processes (lubricating oil extracts), and oils and resins produced in resid solvent extraction processes. The high sulfur crudes from which the high sulfur resids are derived can have an API gravity as low as 1° API, a sulfur content of up to 8 percent by weight, and substantial amounts of nickel and vanadium.

Residual components derived from a crude distillation unit, such as high and low sulfur vacuum residual components (crude vacuum resid), generally comprise a substantial portion of hydrocarbon having an atmospheric equivalent boiling point exceeding 800° F. For purposes of the present invention, a substantial portion shall mean at least about 80 percent by volume. It is generally expected that a "tail fraction" of lighter hydrocarbon can be included with crude vacuum residual components. Excessive tail fractions in crude vacuum residual components are generally uneconomic to the refiner since these fractions are not processed in the optimum refining facilities, are often processed in additional, low value-added facilities, and/or are processed in a less than optimal processing sequence. High sulfur crude vacuum residual components, for purpose of the present invention, generally have a sulfur concentration of at least about 2 percent by weight and typically at least 3 percent by weight. Low sulfur crude vacuum residual components generally have a sulfur concentration of less than 2 percent by weight and typically range from about 0.5 percent by weight to about 1.5 percent by weight. Typical API gravities for crude vacuum resid generally range from about 2° API to about 16° API and typically range from about 6° API to about 10° API.

Residual components suitable for use as a feedstock for upgrading in the initial resid hydrotreating step can also include gas oil boiling range, highly aromatic hydrocarbon components such as FCC decanted oil and lubricating oil extracts. Fluid catalytic cracking processes and lubricating oil manufacturing processes generally utilize gas oil boiling feedstocks which comprise hydrocarbon boiling at temperatures ranging from about 500° F. to about 1100° F. at atmospheric pressure. As a result, aromatic by-products produced from such processes generally boil at temperatures ranging from about 400° F. to about 1100° F. at atmospheric pressure. It has been found that hydrocarbon streams comprising substantial fractions of aromatics are particularly attractive for use in the manufacture of superior quality needle coke. FCC decanted oil (DCO) generally comprises aromatic hydrocarbons in an amount ranging from about 40 percent by weight to about 90 percent by weight and typically from about 60 percent by weight to about 80 percent by weight. Lubricating oil extracts generally comprise aromatic hydrocarbons in an amount ranging from about 30 percent by weight to about 90 percent by weight and typically from about 60 percent by weight to about 80 percent by weight.

Since aromatics are generally denser than other common chemical structures (i.e. paraffins, olefins, etc.) components comprising a high percentage of aromatics generally have low API gravities. As such, although FCC DCO and lubricating oil extracts generally boil at temperatures below that of crude vacuum residual components, their API gravities can be lower than that of high and low sulfur crude vacuum resid. Typical API gravities for FCC decanted oil generally range from about −5° API to about 12° API and typically from about −2° API to about 5° API. Typical API gravities for lubricating oil extracts generally range from about 0° API to about 20° API and typically from about 10° API to about 15° API.

The solvent extracted resin stream from a resid solvent extraction process is also a suitable feedstock for directing to the initial resid hydrotreating step and can be substituted for or added in addition to FCC decanted oil in the RHU. Although FCC decanted oil is a particularly valuable solvent for use in the resid hydrotreating step for controlling carbonaceous solids attendant to the resid hydrotreating process, FCC DCO itself is generally a carrier of cracking catalyst solids or fines derived from the cracking catalyst used in the FCC process. Typical catalytic cracking catalyst generally comprises at least one crystalline molecular sieve for providing enhanced cracking activity (typically a zeolite) along with at least one inert inorganic oxide binder. Such FCC catalyst solids and fines present in FCC decanted oil have a tendency to put undue wear on the valves and various feed and product controls used to process this material in the resid hydrotreating unit. Additionally, the solids and fines in FCC decanted oil directly contribute to increased CTE characteristics in needle coke. Therefore, it is generally preferred to direct FCC decanted oil to the resid solvent extraction process of the present invention for removal of solids and fines and to recycle the resid solvent extraction unit resins stream to the resid hydrotreating process feed. In this manner, much of the FCC DCO stream can be directed to the resid hydrotreating step without inclusion of the solids and fines that can prove deleterious to the resid hydrotreating process. Moreover, the solids and fines are removed from the resid solvent extraction unit resins and oils resulting in a needle coke having superior CTE characteristics. The properties of the resin feedstock are more fully described hereunder.

The resid hydrotreating process of the present invention generally begins with a resid hydrotreater feedstock preheating step wherein waste heat is recovered from downstream process streams to the residual feedstock in a manner so as to reduce preheat furnace heating requirements. The preheated resid feedstock is then directed to a preheat furnace for final heating to a targeted resid hydrotreating reaction zone inlet temperature. The feedstock can be contacted with a hydrogen stream prior to, during, and/or after preheating. The hydrogen-containing stream can also be added to the hydrogenation reaction zone of the resid hydrotreating process.

The hydrogenation stream can be pure hydrogen or can be in admixture with diluents such as low-boiling hydrocarbons, carbon monoxide, carbon dioxide, nitrogen, water, sulfur compounds, and the like. The hydrogen stream purity should be at least about 70 percent by volume hydrogen, preferably at least about 80 percent by volume hydrogen, and more preferably at least about 90 percent by volume hydrogen for best results. Hydrogen can be supplied from a hydrogen plant, a catalytic reforming facility, or other hydrogen-producing or hydrogen-recovery processes known in the art.

The residual feedstock and hydrogen are directed independently or comingled to the resid hydrotreating reaction zone. The reaction zone generally comprises at least one, preferably at least two, and more preferably three or more parallel reaction trains. A plurality of parallel reactor trains provides the refiner the flexibility of taking one or more trains from service for repairs without having to shut the resid hydrotreating unit down. Each reactor train generally comprises at least one, preferably at least two, and more preferably three or more reactors in series. Other suitable reactor arrangements can include staging two or more reactors in series with two or more reactors in parallel in a single train. It is intended in the present invention that the reactor staging be customized to facilitate optimum process capability with maintenance and operational flexibility to best suit the refinery operation.

Suitable reactor types for the resid hydrotreating process in accordance with the present invention include fixed bed reactors, fluidized bed reactors, ebullated bed reactors, and other reactor designs known to those skilled in the art. The preferred reactor type is the ebullated bed reactor. The ebullated bed reactor is the preferred reactor type for use in resid hydrotreating processes for several reasons. Ebullated bed reactors permit operation at higher average reaction temperatures and allow higher heat release. Ebullated bed reactors also permit the addition and removal of resid hydrotreating catalyst from the reaction zone without requiring shutdown of reactors or reactor trains. Similarly, ebullated bed reactors also facilitate the processing of heavy residual components which can carry large amounts of solids and tend to form coke under some process conditions. Heavy components that are directed to the ebullated bed or formed under resid hydrotreating conditions in the reaction zone can be continuously purged from the reaction zone with the turnover of the resid hydrotreating catalyst.

Hydrogenation or hydrotreating in a resid hydrotreating unit, for purposes of the present invention, includes demetallization, desulfurization, denitrogenation, resid conversion, oxygen removal (deoxygenation), hydrocracking, removal of Ramsbottom carbon residue, and the saturation of olefinic and aromatic hydrocarbons. The reaction zone generally comprises contacting the residual feedstock with ebullated or expanded fresh and/or equilibrium hydrotreating catalyst in the presence of hydrogen to produce an upgraded effluent product stream and reactor tail gases, leaving spent or partially deactivated resid hydrotreating catalyst. For purposes of the present invention, "fresh hydrotreating catalyst" shall mean resid hydrotreating catalyst that has not been previously utilized to catalyze hydrogenation. "Equilibrium hydrogenation catalyst" shall mean fresh catalyst which has been previously used to catalyze hydrogenation and can include internally generated equilibrium catalyst and supplemental purchased equilibrium catalyst. "Spent hydrogenation catalyst" shall mean equilibrium catalyst that has been withdrawn from a hydrotreating reactor. Fresh resid hydrotreating catalyst can be substantially higher in hydrogenation activity than equilibrium hydrogenation catalyst but is more costly to use. Equilibrium hydrogenation catalyst can be used to great advantage where supplemental catalyst makeup is constrained by metals or contaminant removal and not reaction activity.

Resid hydrotreating catalyst in accordance with the present invention generally comprises one or more hydrogenation metals incorporated onto an inert inorganic oxide or molecular sieve-containing support component. Suitable hydrogenation metals can include the Group VIB and Group VIII metals, preferably nickel, molybdenum, cobalt, and tungsten, and more preferably nickel and molybdenum for best results. Hydrogenation metals comprising nickel and molybdenum are generally present in the resid hydrotreating catalyst in amounts ranging from about 0.1 percent by weight to about 10 percent by weight and from 0.1 percent by weight to about 20 percent by weight respectively. The hydrogenation metals component can be deposited or incorporated upon the support by impregnation employing heat-decomposable salts of the hydrogenation metal or other methods known to those skilled in the art such as ion-exchange, with impregnation methods being preferred.

Suitable support components can include the inert inorganic oxides and the molecular sieve supports. The preferred support components are the large-pore, high surface area porous inorganic oxides and particularly, commercially available large-pore, high surface area alumina. For best results, the inert inorganic oxide support should have an average pore diameter ranging from about 100 Å to about 300 Å and a surface area ranging from about 150 $m^2$/gram to about 300 $m^2$/gram.

The resid hydrotreating reactors are generally flexible and can be operated with the same catalyst directed to all reactors in series or with different catalysts. For example, since the first reactor in a reactor train generally provides a larger proportion of the demetallization, the first reactor can be a candidate for increased rates of equilibrium catalyst. The spent catalyst from the first reactor in a reactor train can contain a higher concentration of nickel, vanadium, and carbon (coke) by way of its position in the reactor train and the composition of the feedstock as it enters the first reactor. Similarly, spent catalyst from the third reactor in the train, which is generally exposed to a feedstock that has a substantially lower metals content than the feedstock to the first or second reactor, can be used as catalyst for directing to the first reactor of the train.

The reaction zone operating conditions to be used in the resid hydrotreating process of the present invention generally comprise an average reaction zone temperature of from about 700° F. to about 900° F., preferably from about 750° F. to about 850° F., and more preferably from about 780° F. to about 850° F. for best results. Reaction temperatures below these ranges can result in less effective or less complete hydrogenation. Excessively high temperatures can result in increased catalyst deactivation and higher energy costs.

The reaction zone pressures generally range from about 1000 psig to about 5000 psig, preferably from about 2000 psig to about 4000 psig, and more preferably from about 2500 psig to about 3500 psig for best results. The hydrogen partial pressures are generally maintained at a level above 800 psig, preferably above 1600 psig, and more preferably above 2000 psig for best results. Reaction pressures and hydrogen partial pressures below these ranges can result in accelerated catalyst deactivation resulting in increased catalyst usage and/or less effective hydrogenation. Excessively high reaction pressures and hydrogen partial pressures generally increase energy and equipment costs and provide diminishing marginal benefits.

The reaction zone liquid hourly space velocity (LHSV) generally ranges from about 0.05 $hr^{-1}$ to about 0.7 $hr^{-1}$, preferably from about 0.1 $hr^{-1}$ to about 0.5 $hr^{-1}$, and more preferably from about 0.15 $hr^{-1}$ to about 0.3 $hr^{-1}$ for best results. Excessively high space velocities can result in reduced overall hydrogenation.

The residual feedstock and the hydrogen-containing stream are generally directed into the bottom of the ebullated bed reactor wherein the feedstock and hydrogen flow upwardly through a distributor plate into the reactor bed of resid hydrotreating catalyst. The bubbling action of the hydrogen-containing stream results in liquid turbulence in the catalyst bed which enhances catalyst, oil, and hydrogen mixing. A vertical downcomer conduit with an open ended upper top and a bottom in communication with the suction of an ebullated bed recycle pump, is provided in the center of the ebullated bed reactor. As hydrocarbon proceeds upwardly through the ebullated bed reactor, upon reaching the elevation of the open end of the vertical downcomer conduit, some of the stream enters the conduit, flows downwardly through the conduit into the ebullated bed pump, and is recycled back through the distributor plate into the ebullated bed reactor. In this manner, liquid superficial velocities can be maintained so as to expand the ebullated bed and increase or maintain catalyst, oil, and hydrogen contact and reduce temperature gradients in the bed. The fresh or equilibrium makeup resid hydrotreating catalyst is generally added to the top of the ebullated bed reactor while spent catalyst is removed from the bottom.

The upgraded effluent product from the ebullated reactors is then generally directed to a series of single stage flash and multistage fractionation steps for the separation of a recycle hydrogen stream for redirecting back to the process and for the fractionation of the product streams into boiling ranges that are suitable for downstream processing steps. Typically, the ebullating bed effluent is directed to at least one flash separation step for removing hydrogen from the effluent products. The hydrogen separation is not particularly difficult and can be performed, at the proper temperatures and pressures, with a single stage flash separator without complex fractionating vessel internals. The hydrogen that is removed overhead the flash drums during the flash separation stages is generally processed through an amine contactor or absorber for the removal of hydrogen sulfide from the hydrogen-containing stream. After removal and hydrogen-sulfide adsorption of the hydrogen-containing stream, a portion of the hydrogen-containing stream can be compressed in a recycle gas compressor and directed back into the process. A portion of the hydrogen-containing stream is generally purged to an internal refinery fuel system for maintaining hydrogen purity.

The hydrocarbon product which remains after flash separation of the hydrogen from the upgraded effluent product is generally directed to downstream fractionation steps for providing products specifically tailored for downstream refining processes. The hydrocarbon stream is typically directed to an atmospheric fractionation step for fractionating the stream into streams such as light naphtha, consisting essentially of hydrocarbon comprising a substantial portion of hydrocarbon having 6 carbon atoms or less; heavy naphtha consisting essentially of hydrocarbon having between 7 and 12 carbon atoms; distillate, consisting essentially of hydrocarbon boiling at a temperature ranging from about 150° F. to about 700° F. at atmospheric pressure; light gas oil, consisting essentially of hydrocarbon boiling at a temperature ranging from about 400° F. to about 800° F. at atmospheric pressure; and an atmospheric bottoms product that generally comprises hydrocarbon boiling at a temperature ranging from about 600° F. to about 1200° F.

The atmospheric bottoms products can then be directed to a vacuum resid furnace for preheating the atmospheric bottoms product for subsequent fractionation in a resid hydrotreating unit vacuum tower. The vacuum distillation step is generally conducted at subatmospheric pressures so as to provide fractionation without having to exceed fractionation temperatures that can accelerate the formation of coke in piping and associated equipment. The vacuum tower generally separates the hydrocarbon into fractions such as vacuum naphtha consisting essentially of hydrocarbon having between 4 and 12 carbon atoms, light vacuum gas oil consisting essentially of hydrocarbon boiling at a temperature ranging from about 400° F. to about 800° F. at atmospheric pressure, heavy vacuum gas oil consisting essentially of hydrocarbon boiling at a temperature ranging from about 400° F. to about 1100° F. at atmospheric pressure, and hydrotreated vacuum resid generally boiling at a temperature of greater than about 800° F. at atmospheric pressure.

The hydrotreated vacuum resid, for purposes of the present invention, is generally combined with other feedstock components and directed to a resid solvent extraction process for removal of asphaltenes and the preparation of a deasphalted resins and oil feedstock for processing in a delayed coking process for producing needle coke. Other feedstock components that can be directed to the resid solvent extraction process generally include FCC decanted oil and lubricating oil extracts. These hydrocarbon components, which generally boil at temperatures attendant to gas oil, can be highly aromatic which generally improves needle coke CTE characteristics. However, FCC decanted oil and lubricating oil extracts can also contain substantial solids, fines, and ash concentrations that adversely affect needle coke CTE characteristics. These characteristics of FCC decanted oil and lubricating oil extracts are not particularly burdensome to, and in fact, are improved by the resid solvent extraction process in accordance with the present invention.

It is preferred that all, or a substantial portion of the feedstock that is directed to the delayed coker for the production of needle coke, be first directed to the resid solvent extraction process. As such, the mix of the above feedstock components in the feedstock to the resid solvent extraction process can be particularly important.

For example, the combined resid solvent extraction process feedstock comprising hydrotreated vacuum resid from the resid hydrotreating process, the FCC decanted oil, and lubricating oil extracts if desirable or available, should comprise a sulfur content ranging from about 0.1 percent by weight to about 2.0 percent by weight, preferably 0.1 percent by weight to to about 1.6 percent by weight, and more preferably 0.1 percent by weight to about 1.0 percent by weight for best results. Lower feedstock sulfur contents generally result in a more valuable lower sulfur needle coke having better dynamic puffing characteristics and reduce the necessity of having to remove a deeper cut of asphaltenes from the resid solvent extraction process feedstock for needle coke sulfur and dynamic puffing control.

Similarly, the combined resid solvent extraction process feedstock comprising hydrotreated vacuum resid from the resid hydrotreating process, FCC decanted oil, and lubricating extracts if desirable or available, should comprise an aromatics content ranging from about 30 percent by weight to about 90 percent by weight, preferably from about 40 percent by weight to about 80 percent by weight, and more preferably from about 50 percent by weight to about 70 percent by weight for best results. Higher aromatics contents generally result in a more valuable lower CTE needle coke.

As such, it is preferred that the mix of feedstock components be controlled in a manner so as to provide a needle coke delayed coker feedstock that maximizes the market value of products produced at the needle coker. This control step can be performed in any one of several ways such as, but not limited to, base loading the solvent extraction process with hydrotreated vacuum resid and balancing the proportion of FCC decanted oil in the feedstock blend to meet the limiting specification of needle coke CTE, sulfur content, or dynamic puffing. The control step may also comprise a simple ratio control of hydrotreated vacuum resid to FCC decanted oil in order to meet the limiting step specification of needle coke CTE, sulfur content, or dynamic puffing.

The resid solvent extraction process generally comprises at least one mixer and two or more critical solvent extraction or separation stages which are operated slightly below or above the critical condition of the solvent. For purposes of the present invention, the critical temperatures and pressures of the solvents generally used in the resid solvent extraction process in accordance with the present invention are as follows:

TABLE 1

| | Temperature (°F.) | Pressure (psig) |
|---|---|---|
| Propane | 206 | 601 |
| i-Butane | 275 | 514 |
| n-Butane | 306 | 536 |
| Pentane | 386 | 474 |
| Hexane | 454 | 422 |
| Heptane | 513 | 382 |

The preferred solvents for use in the present invention are the non-aromatic C3 to C7 hydrocarbons, preferably propane, butane, pentane, their isomers, and mixtures thereof, and more preferably propane and isobutane for best results. Propane and isobutane are preferred for use with the integrated process of the present invention since the solvents having lower critical temperatures provide superior performance to the solvents having higher critical temperatures, particularly at lower solvent extracted resin and oil yields. For example, the use of propane and isobutane solvents in the solvent extraction step can provide greater reductions in solvent extracted resin and oil viscosity, specific gravity, sulfur concentration, Ramsbottom carbon residue, and metals content (including nickel and vanadium), at solvent extracted resin and oil yield ranges extending from about 0 percent by weight as a fraction of feed to as high as 50 percent by weight, generally as high as 60 percent by weight, and often as high as 80 percent by weight.

The resid solvent extraction process feedstock is generally directed to a mixer where the feedstock is combined with a minor amount of fresh and/or make up solvent, and the mixed stream directed to the upper portion of a first extraction or separation zone. Additional solvent is added to the bottom of the first extraction zone to create a countercurrent flow of solvent flowing upwardly and resid solvent extraction process feedstock, and particularly the asphaltene fraction of the feedstock, flowing downwardly. The countercurrent flow dynamics in the extraction zones are generally the result of the differences in density of the various components in the extraction zone.

For purposes of the present invention, the ratio of total solvent (fresh and recycle solvent) to feedstock, by volume, ranges from about 3:1 to about 20:1 and preferably from about 8:1 to about 12:1 for best results. Under some circumstances, it may be desirable to use or include other solvents in the same or in different extraction zones. It is intended that the preferred ratios of solvent to feedstock apply to the cumulative amount of all solvent added to each extraction zone independently and on a zone by zone basis.

In the first extraction zone (asphaltene separator), an asphaltene phase is formed comprising asphaltenes. For purposes of the present invention, the term "asphaltenes" shall mean the asphaltenes which have been separated or removed in a deasphalting process. Asphaltenes generally comprise heavy polar components and are characterized as having a Conradson or Ramsbottom carbon residue ranging from about 30 percent by weight to about 90 percent by weight and a hydrogen to carbon (H/C) atomic ratio of 0.5 to about 1.2. Asphaltenes can contain from about 50 ppm to about 5000 ppm vanadium and from about 20 ppm to about 2000 ppm nickel. The sulfur content of asphaltenes generally ranges from about 110 percent to about 250 percent greater than the concentrations of sulfur in the solvent extraction process feedstock. The nitrogen concentration of the asphaltenes can range from about 110 percent to about 350 percent of the concentration of nitrogen in the solvent extraction process feedstock.

In the asphaltene separator, catalyst solids and fines present in the FCC decanted oil and asphaltenes drop into the heavy asphaltene phase (DAP asphaltenes), where they are withdrawn and directed to a solid fuels area, to a fuel grade coker for the production of fuel grade coke, or to No. 6 oil blending component storage. The remaining stream comprising resins, oils. and solvent can be directed to a second extraction stage for the separation of resins from oils and solvent.

The asphaltene separator is generally operated at a temperature ranging from about 150° F. to near the critical temperature of the solvent and at a pressure at least equal to the vapor pressure of the solvent when operating at a temperature below the critical temperature of the solvent and at least equal to the critical pressure of the solvent when at a temperature equal to or above the critical temperature of the solvent. Preferably, the operating temperature of the asphaltene separator ranges from about 20° F. below the critical temperature of the solvent to about the critical temperature of the solvent. The operating pressure of the asphaltene separator is substantially the same as, and is generally determined by, the operating pressure of the second extraction zone plus any pressure drops between the asphaltene separator and the second extraction stage.

In a three or more stage process, the second extraction zone of the resid solvent extraction process is generally the resin separator for separating DAP resins from DAP oils and solvent. For purposes of the present invention, the term DAP resins or "deasphalted resins" shall mean the resins that have been separated and obtained from a deasphalting process. Resins generally have a higher density than deasphalted oil and comprise more aromatic hydrocarbons with highly aliphatic substituted side chains. Resins also comprise metals such as nickel and vanadium and comprise more heteroatoms than deasphalted oil. Resins from resid solvent extraction process feedstock are characterized as having a Conradson or Ramsbottom carbon residue ranging from about 10 percent by weight to about 30 percent by weight and a hydrogen to carbon (H/C) atomic ratio of 1.2 percent to about 1.5 percent. Resins generally contain less than about 1000 ppm vanadium and less than about 300 ppm nickel. The sulfur content of resins generally ranges from about 50 percent to about 200 percent of the concentration of sulfur in the solvent extraction process feedstock. The nitrogen concentration of the resins can range from about 30 percent to about 250 percent of the concentration of nitrogen in the solvent extraction process feedstock.

The majority of the solvent, DAP resins, and DAP oil components of the resid solvent extraction process feedstock are withdrawn from the top of the asphaltene separator and conveyed to a heating means for elevating the operating temperature of the resins separator. Such heating means can include conventional process heat exchange, a process furnace, or other heating means known to those skilled in the art. The resins separator is generally maintained at a higher operating temperature than that of the asphaltene separator and at the same pressure as the asphaltene separator less any pressure drops between vessels. Preferably, the operating temperature of the resins separator is from about 5° F. to about 100° F. above the temperature of the asphaltene separator and more preferably from about 5° F. to about 50° F. above the critical temperature of the solvent. In the resins separator, the solvent, DAP resins, and DAP oils are separated into a top phase comprising solvent and DAP oils and a lower phase comprising DAP resins and a minor amount of solvent.

The hydrocarbon from the bottom phase comprising DAP resins and a minor amount of solvent can be recycled back to the resid hydrotreating process for use as a diluent to control carbonaceous solids formation and/or for an additional reduction in the sulfur level of resid solvent extraction process feedstock. It is preferred that a substantial portion of the resins stream be directed to needle coker feed for the production of high quality needle coke in accordance with the present invention. The resins stream can also be recycled back to the resins separator in a manner so as to increase superficial separator velocity and increase solvent and oil mixing. The hydrocarbon from the top phase comprising DAP oils and solvent can be directed to a third separation stage for the separation of solvent from the DAP oil.

The DAP oil and solvent is conveyed from the resin separator to a heating means for preheating the DAP oil and solvent prior to entering a third separation or extraction zone. The third separation zone is also referred to as an oil separator and is provided for separating DAP oil from the resid solvent extraction process solvent. For purposes of the present invention, the term DAP oil or "deasphalted oil" shall mean the oils that have been separated and obtained from a deasphalting process. Deasphalted oils generally have the lowest density of all products produced on the resid solvent extraction process and comprise saturated aliphatic, alicyclic, and aromatic hydrocarbons. Deasphalted oil generally comprises less than 30 percent by weight aromatic carbon and low levels of heteroatoms except sulfur. Deasphalted oil from resid solvent extraction process feedstock is characterized as having a Conradson or Ramsbottom carbon residue ranging from about 1 percent by weight to about 12 percent by weight and a hydrogen to carbon (H/C) atomic ratio of 1.5 to about 2.0. Deasphalted oil generally contains less than about 50 ppm vanadium, preferably less than about 5 ppm vanadium, and more preferably less than about 2 ppm vanadium for best results. Similarly, deasphalted oil generally contains less than about 50 ppm nickel, preferably less than about 5 ppm nickel, and more preferably less than about 2 ppm nickel for best results. The sulfur and nitrogen concentrations of the deasphalted oil can be and are generally less than 90 percent of the concentration of sulfur in the solvent extraction process feedstock.

The third separation zone or oil separator is generally operated as a single stage flash zone wherein solvent is separated from the deasphalted oil. When operating at supercritical conditions, the separation can be made with little or no additional heat addition, thereby enhancing the energy efficacy of the resid solvent extraction process.

The first, second, and third heavy phases of asphaltenes, resins, and deasphalted oil respectively, can be passed into individual stripping sections, such as steam strippers, to strip any solvent that may remain in these streams. The solvent that is recovered from such strippers or from the deasphalted oil extraction zone can be cooled or condensed, retained in a surge drum, and recycled back to the process for further extraction.

Where the resid solvent extraction process is a two-stage process, the process remains similar in most respects, except that the solvent is separated from the mixture of resins and oil in the second separator or zone and a combined product of resins and oil produced. The deasphalted oils and resins stream properties from a two-stage process are generally a composite of the properties of the deasphalted oils and deasphalted resins streams described hereabove. The resins and oil stream from such a two-stage process is also suitable for recycling back to the resid hydrotreating process for use as a diluent to control carbonaceous solids formation and/or for an additional reduction in the sulfur level of resid solvent extraction process feedstock, for directing to needle coker feed for the production of high quality needle coke in accordance with the present invention, and/or for recycling back to the second separator in a manner so as to increase superficial separator velocity and increase solvent and hydrocarbon mixing.

Alternatively, the resid solvent extraction process feedstock and solvent can be directed to a first separation zone comprising a closed vessel which is maintained at temperature and pressure conditions sufficient to permit the formation of three separate liquid fractions having two distinct liquid-liquid interfaces between the three separate liquid fractions. The liquid fractions comprise an asphaltene-rich heavy fraction which collects in the bottom portion of the first separator, a resin-rich intermediate fraction which collects immediately above the heavy fraction, and a light oil fraction comprising a major portion of the solvent, which collects immediately above the intermediate fraction. In order to facilitate the formation of each adjacent fraction, the first separation zone is generally operated at a temperature within about 30° F. of the critical temperature of the solvent, and at a pressure at or above the critical pressure of the solvent and preferably within about 300 psig above the critical pressure of the solvent. Each fraction can be withdrawn from the first separator in a manner so as to maintain interface levels, directed to solvent stripping towers, and finally to downstream processing steps.

In still another embodiment of the process of the present invention, the second stage of the solvent extraction process for separating deasphalted oils from deasphalted resins (resin separator) can be performed using a distillation step instead of a solvent extraction step. While such a process operation is generally more costly in terms of energy consumption, under some conditions, distillation can provide an improved separation between deasphalted oil and deasphalted resins.

All or a fraction of the resins and deasphalted oil streams are directed to a delayed coking process for the manufacture of needle coke. It has been found that feedstocks prepared in the manner described hereabove can provide superior needle coke when processed under needle coking process conditions.

The preferred needle coker feedstock for use with the present invention generally comprises an aromatics concentration ranging from about 30 percent by weight to about 95 percent by weight, preferably from about 40 percent by weight to about 90 percent by weight, and more preferably from about 50 percent by weight to about 80 percent by weight for best results. Higher aromatics contents generally result in a more valuable lower CTE needle coke. While not wishing to be bound to any particular theory, it is believed that aromatic hydrocarbons comprising hexagonal ring structures more easily and homogeneously form the hexagonal structures attendant to needle coke. In this manner, the needle coke is generally more uniform and subject to reduced levels of thermal expansion.

The preferred needle coker feedstock for use with the present invention generally comprises an ash concentration ranging from about 0.001 percent by weight to about 0.1 percent by weight, preferably from about 0.001 percent by weight to about 0.05 percent by weight, and more preferably from about 0.001 percent by weight to about 0.01 percent by weight for best results. High ash concentrations in the needle coker feedstock can and generally result in higher needle coke CTE.

The preferred needle coker feedstock for use with the present invention generally comprises a sulfur concentration ranging from about 0.1 percent by weight to about 1.6 percent by weight, preferably from about 0.1 percent by weight to about 1.0 percent by weight, and more preferably from about 0.1 percent by weight to about 0.7 percent by weight for best results. Lower feedstock sulfur concentrations generally result in a more valuable lower sulfur needle coke. Similarly, lower feedstock sulfur concentrations generally result in preferred dynamic puffing characteristics. It is believed that dynamic puffing is generally correlated to the presence of elements such as sulfur in the coke which can form impurity pockets and fracture sites. The presence of fracture sites present in coke having poor dynamic puffing characteristics, can and generally does reduce electrode life in arc furnaces used in the manufacture of steel.

For purposes of the present invention, the delayed coker feedstock produced from the processes described hereabove should preferably have the following characteristics:

TABLE 2

| | |
|---|---|
| API Gravity @ 60° F. | 0.0–10.0 |
| Sulfur, wt % | 0.0–0.7 |
| Aromatics, $C_4$, wt % | 50.0–80.0 |
| Nitrogen, wt % | 0.0–0.7 |
| Metals | |
| Vanadium, ppm | 50 max |
| Nickel, ppm | 50 max |
| Pentane Insolubles, wt % | 8 max |
| Benzene Insolubles, wt % | 1 max |
| Quinoline Insolubles, wt % | 1 max |
| Boiling range, °F. | 500° F.+ |
| Ash, wt % | 100 ppm max |

The delayed coking process for producing needle coke generally begins with a preheating step wherein the needle coker feed can be preheated with waste heat recovered from downstream sections of the process. The preheated feedstock can then be directed to a coking furnace wherein the needle coker feed is heated to coking temperatures. The needle coker feed exits the coker furnace through a transfer line and is directed to a coking zone generally comprising coke drums.

Coking conditions for the production of needle coke generally include a transfer line maintained at a temperature ranging from about 900° F. to about 980° F., preferably from about 920° F. to about 960° F., and more preferably from about 930° F. to about 960° F. for best results. Pressures are generally regulated in the coke drum and range from about 15 psig to about 150 psig and preferably from about 30 psig to about 80 psig for best results. Vapor residence time in the coke drums can range from a few seconds up to two or more minutes. Stripping steam can be added to the needle coker feed passing into the coke drum to help remove volatile hydrocarbon components from the produced coke at rates ranging from about 0.2 pounds of steam per hundred pounds of total feed passing into the coke drum to about 5.0 pounds of steam per hundred pounds of total feed passing into the coke drum.

The coke drums themselves are generally elongated, cylindrical, vertically positioned vessels with an outwardly convex top and a downwardly converging frustro conical bottom into which feed can pass. The heated feed within the coke drum passes in an upward direction and, by way of the coking reaction, is ultimately converted to solid coke also referred to as "green" coke and liquid and vapor products. The coke drums have coke drum outlets which can be positioned on the top of the coke drum and radially outward from the vertical longitudinal axis of the drum, or on the side of the upper section of the drum.

Delayed coking operations for producing needle coke are generally cyclic in nature, having the following cycles of operations:

(1) coke production wherein the heated needle coker feedstock is directed to a coke drum or battery of coke drums under conditions which cause the formation of solid coke and vapor products;

(2) switching the heated needle coker feedstock to another coke drum or battery of coke drums upon filling of the first battery of coke drums;

(3) a quenching cycle wherein steam usually followed by water is added to the first battery of coke drums, after feedstock addition has stopped, to cool the contents of the coke drums and purge them of hydrocarbon vapor;

(3) coke removal wherein the coke drums are opened to the atmosphere and solid coke is removed from the drums;

(4) a purge and pressure test cycle wherein the coke drums are filled with steam to remove air from the drums; and (5) coke drum heat-up using hot vapor from the second battery of coking drums.

After the last cycle takes place, the first cycle begins again.

The hydrocarbon product that exits the coke drums is generally directed to a main fractionating column which is also commonly referred to as a combination tower. The main fractionating column separates the hydrocarbon from the coking drums by boiling range into products such as coker wet gas, coker cracked naphtha, coke still distillate, and coker gas oil. The coker wet gas generally comprises a substantial portion of hydrocarbon having 5 carbon atoms or less and also comprises a substantial portion of olefinic hydrocarbons in addition to paraffins by way of the thermal cracking process. The coker cracked naphtha generally comprises a substantial portion of hydrocarbon having from between 4 and 12 carbon atoms and also comprises a substantial portion of olefins in addition to paraffins and some aromatics. The coker distillate substantially comprises hydrocarbon boiling at a temperature ranging from about 150° F. to about 700° F. at atmospheric pressure. The coker gas oil generally comprises hydrocarbon boiling at a temperature ranging from about 400° F. to about 1100° F. at atmospheric pressure.

The high quality needle coke produced in accordance with the integrated needle coking process of the present invention is particularly suitable for use in the manufacture of electrodes for electric arc steel furnaces as measured by its physical and chemical properties in relationship to industry standards and specifications. The needle coke in accordance with the present invention can be produced to a CTE of less than $8\times10^{-7}$/°C., less than $5\times10^{-7}$/°C., and where required, less than $3\times10^{-7}$/°C. These CTE performance levels apply for rods having either 0 percent by weight or 2 percent by weight iron oxide. The CTE of a graphitized coke is an important measure of its suitability for use in the manufacture of electrodes for electric arc steel furnaces and is commonly determined through laboratory tests that can vary from manufacturer to manufacturer.

CTE can be determined by milling, extruding, baking, and graphitizing needle coke into rods of a predetermined length at temperatures of around 2900° C. The extrusion mixture can comprise coke flour, coal tar, pitch binder, extrusion oil, and if desired, various levels of a specified iron oxide. The linear thermal expansion is often measured with an amplified transducer using a fused silica dilatometer and water bath system over temperatures ranging from about 0° C. to about 50° C. The reported CTE values are generally the average of at least two and generally three or more tests using different rods from the same extrusion mixture.

The needle coke in accordance with the present invention can be produced to a sulfur and nitrogen concentration of less than 1.6 percent by weight, less than 1.0 percent by weight, and where required, less than 0.7 percent by weight. The sulfur and nitrogen concentrations can be determined using laboratory methods such as D4239 for sulfur and D4629 for nitrogen respectively. High sulfur and nitrogen concentrations can cause fracture sites in the needle coke, which generally reduce electrode life.

The presence of fracture sites in needle coke, often correlated to and caused by high sulfur and nitrogen concentrations, can also be reflected in the dynamic puffing characteristics of the needle coke. The needle coke in accordance with the present invention can be produced to a dynamic puffing level of less than 7 percent of the length of a dynamic puffing plug, less than 4 percent, and where required, less than 2 percent.

Dynamic puffing characteristics can be determined by preparing a mixture of calcined petroleum needle coke having particle sizes ranging from about −35 mesh (Tyler) to flour, a coal tar pitch binder, and if desired various levels of a specified iron oxide. The mixture is generally hot pressed into the form of a puffing plug in an electrically heated mold at high pressures ranging from about 20,000 psig to about 30,000 psig for a period time ranging from about 15 seconds to about 1 minute at a temperature of about 110° C. The puffing plug can then be baked to a temperature ranging from about 700° C. to about 1000° C. The puffing plug with a dilatometer are heated in a graphite tube furnace (graphitizer) at a substantially constant heating rate ranging between about 10° C./minute and about 20° C./minute over the temperature range of from about 1000° C. to about 2900° C. under a nitrogen purge. The temperature and dilatometer deflection readings are generally recorded at constant time intervals and plotted. The maximum and minimum deflection points of the puffing plug are determined over the temperature interval described above and the difference in deflection between the minimum and maximum deflection points are determined and expressed as a percentage of the length of the puffing plug.

The integrated process of the present invention provides the petroleum refiner superior flexibility and numerous options for meeting or exceeding the highest standards of quality for needle coke.

The CTE characteristics of the needle coke can be modified by any one or more of several methods, including, but not limited to customizing the aromatics concentration of the needle coker feed by adjusting the FCC DCO flowrate to the RHU, adjusting the FCC DCO flowrate to the resid solvent extraction process, adjusting the lube oil solvent extraction process extracts flowrate to the resid solvent extraction process, or adjusting the flowrate of other highly aromatic feedstocks such as pyrolysis oil to the RHU or resid solvent extraction process. Similarly, the CTE characteristics of the needle coke can be modified by customizing the solids and asphaltenes concentrations of the delayed needle coker feed such as by adjusting demetallization at the RHU, adjusting resins and oils yields at the resid solvent extraction process, and adjusting solids recovery and removal levels from feedstock components such as FCC DCO in pretreating steps prior to the delayed needle coking process.

The sulfur and nitrogen concentrations and the dynamic puffing characteristics of the needle coke can also be modified by any one or more of several methods, including, but not limited to reducing the sulfur concentration of the RHU feedstock. RHU feedstock sulfur concentration customization can be achieved by adjusting the mix of low sulfur to high sulfur resid processed, adjusting the recycle flowrate of lower sulfur hydrocarbon streams back to the process such as the oils and resins streams from the resid solvent extraction process and FCC DCO, or by adjusting the internal reactor recycle on one or more of the RHU reactors. The sulfur and nitrogen concentrations and the dynamic puffing characteristics can also be modified by adjusting hydrotreating severity at the RHU by methods such as adjusting catalyst activity and process conditions such as temperature, pressure, space velocity, and hydrogen circulation. Similarly, the sulfur and nitrogen concentrations and the dynamic puffing characteristics can also be modified by adjusting the solvent extracted resins and oil yield from the solvent extraction process. Lower yields of solvent extracted resins and oils can be and are generally correlated to lower concentrations of sulfur and nitrogen in the delayed needle coker feed and lower needle coke sulfur and nitrogen concentrations and dynamic puffing characteristics.

Where additional operating flexibility is desired, the delayed needle coker feedstock can be hydrotreated in an optional hydrotreating step so as to further reduce the sulfur and nitrogen concentrations and improve the dynamic puffing characteristics of the needle coke. The standards for preparing high quality needle coker feed can be attained under more variations of operations wherein facility exists for hydrotreating the needle coker feed. The hydrotreating process generally comprises contacting the needle coker feedstock or components thereof with a hydrotreating catalyst at hydrotreating conditions in a manner so as to reduce the sulfur and nitrogen concentrations of the feedstock for producing improved quality needle coke.

The hydrotreating catalyst generally comprises one or more hydrogenation metals incorporated onto an inert inorganic oxide or molecular sieve-containing support component. Suitable hydrogenation metals can include the Group VIB and VIII metals, preferably nickel, molybdenum, cobalt, and tungsten, and more preferably cobalt and molybdenum for best results. Hydrogenation metals comprising cobalt and molybdenum are generally present in the needle coker feed hydrotreating catalyst in amounts ranging from about 0.1 percent by weight to about 10 percent by weight and from about 0.1 percent by weight to about 20 percent by weight respectively. The hydrogenation metals component can be deposited or incorporated upon the support by impregnation employing heat-decomposable salts of the hydrogenation metal or other methods known to those skilled in the art such as ion-exchange, with impregnation methods being preferred.

The delayed coker feedstock hydrotreating process conditions generally comprise an operating temperature ranging from about 400° F. to about 800° F., preferably from about 550° F. to about 800° F., and more preferably from about 650° F. to about 750° F. for best results. The operating pressure generally ranges from about atmospheric pressure to about 3000 psig, preferably from about 500 psig to about 2500 psig, and more preferably from about 1000 psig to about 2000 psig for best results.

The needle coker feedstock hydrotreating step can be performed by a dedicated hydrotreating facility, on other hydrotreaters that have been specially retrofitted for such a service, or can be performed, on a blocked out or batch basis on an existing hydrotreater that may routinely process other feedstocks such as gas oil or distillate.

Therefore, the integrated delayed needle coking process of the present invention provides a mechanism for meeting needle coke CTE and dynamic puffing specifications with minimal resid quality limitations and without substantially constraining the crude selection process. The flexibility of the present invention with regard to meeting needle coke specifications permits the refiner to process substantially all types of crudes, whether these crudes are particularly low or high in sulfur content, low or high in API gravity, paraffinic or naphthenic, or high in metals.

The integrated delayed coking process of the present invention provides maximum flexibility for accommodating needle coke specifications with alternative process embodiments. In addition to providing a process for the efficient and reliable production of high quality needle coke, the present invention provides a strong process foundation for removing existing equipment from service while continuing to provide high quality needle coke. For example, the flexibility provided by the present invention permits a refiner to remove several operating systems from service for routine maintenance while having backup systems in place to maintain operating efficiency.

The present invention is described in further detail in connection with the following examples, it being understood that the same are for the purpose of illustration and not limitation.

EXAMPLE 1

Fluid catalytic cracking unit decanted oil (FCC DCO) from the Amoco Oil Company Texas City refinery was hydrotreated for use as needle coker feedstock to provide for a comparison with the process of the present invention. The hydrotreating step was performed over a hydrotreating catalyst comprising nickel and molybdenum hydrogenation metals on an alumina support. Half of the FCC DCO was hydrotreated at hydrotreating conditions comprising a reactor temperature of 709° F., a reactor pressure of 1290 psig, a liquid hourly space velocity (LHSV $hr^{-1}$) of 0.47, and a hydrogen flowrate of 1678 SCF/Bbl and half of the FCC FCO was hydrotreated at hydrotreating conditions comprising a reactor temperature of 709° F., a reactor pressure of 1600 psig, a liquid hourly space velocity (LHSV $hr^{-1}$) of 0.47, and a hydrogen flowrate of 1661 SCF/Bbl. The hydrotreated products were recombined to form a hydrotreated FCC DCO feedstock. The properties of the hydrotreated FCC DCO are provided in Table 3 as Stream 1.

EXAMPLE 2

Resid hydrotreating process hydrotreated vacuum resid from the Resid Hydrotreating Unit (RHU) at the Amoco Oil Company Texas City Refinery, produced in accordance with the methods described hereabove, was combined with unhydrotreated FCC DCO. The hydrotreated vacuum resid comprised 60 percent by volume of the mixture with the balance being FCC DCO. The properties of the unhydrotreated FCC DCO, the hydrotreated vacuum resid, and the mixture are provided in Table 3 as Streams 2, 3, and 4 respectively.

The mixture was solvent extracted using n-pentane as the supercritical solvent in a two stage process wherein a deasphalted or solvent extracted oil and resins product and an asphaltene by-product were produced. The solvent extraction was performed at resid solvent extraction conditions consistent with those disclosed hereabove. The deasphalted oil and resins yield, calculated by weight and as a percentage of the feed mixture, was 89.5 percent. The properties of the deasphalted oil and resins product are provided in Table 3 as Stream 5.

EXAMPLE 3

The deasphalted oil and resins product of Example 2 was hydrotreated at a rate of 195 grams/hr over 368 grams of a hydrotreating catalyst comprising nickel and molybdenum hydrogenation metals on an alumina support at hydrotreating conditions comprising a reactor temperature of 709° F., a reactor pressure of 1200 psig, a liquid hourly space velocity (LHSV $hr^{-1}$) of 0.6, and a hydrogen flowrate of 3.0 SCFH. The properties of the hydrotreated deasphalted oils and resins product are provided in Table 3 as Stream 6.

TABLE 3

| | STREAM | | | | | |
|---|---|---|---|---|---|---|
| COMPOSITION | 1 | 2 | 3 | 4 | 5 | 6 |
| CARBON, WT % | 90.72 | 90.19 | 87.97 | 88.82 | 88.52 | 88.92 |
| HYDROGEN, WT % | 8.70 | 7.96 | 9.64 | 8.97 | 9.42 | 10.23 |
| NITROGEN, WT % | 0.34 | 0.12 | 0.59 | 0.42 | 0.34 | 0.255 |
| SULFUR, WT % | 0.24 | 1.45 | 1.47 | 1.47 | 1.42 | 0.44 |
| ORA ANALYSIS | | | | | | |
| OIL WT % | 37.8 | | 26.5 | 24.2 | 32.7 | |
| RESINS, WT % | 51.3 | | 63.5 | 64.7 | 66.9 | |
| ASPHALTENES, WT % | 0.9 | | 7.4 | 8.7 | 0.4 | |
| $C_a$-AROMATICS-NMR | 56.9 | 67.6 | 44.4 | 54.1 | 50.3 | 39.9 |
| ATOMIC H/C RATIO | 1.151 | 1.050 | 1.310 | 1.200 | 1.277 | 1.381 |
| RAMSCARBON, wt % | 4.26 | 4.22 | 22.50 | 15.4 | 7.83 | 4.93 |
| API GRAVITY @ 60° F. | 3.1 | 0.9 | 3.6 | 2.9 | 5.7 | 10.1 |

EXAMPLE 4

Streams 1, 5, and 6 described in Examples 1, 2, and 3 were processed in two delayed coker pilot plants for producing needle coke in accordance with the present invention. The first delayed coking test was performed in a delayed coking pilot plant located at the Amoco Oil Company Naperville, Ill. Research Center (AOC). The test consisted of processing the feedstocks described above through a feed tank and a feed before combining the feedstock with steam in an amount equal to about 2 percent by weight of the feed. The mixture of the feedstock and steam was directed to a preheater for heating the mixture to delayed coking conditions prior to conveying the stream to an upflow delayed coking drum. The delayed coking drum was operated at a temperature of 880° F. which correlated to a commercial furnace transfer line temperature of about 945° F. to about 950° F. and at a pressure of 40 psig. The overheat product of the coking drum was collected and separated in a liquid/gas separator and the gas yield was measured with a wet test meter. After fully processing the feedstock batch, the green coke was steamed for 2 hours and heated for 1 hour. The coke was then cooled for 12 hours by natural convection and cut from the coke drum manually. The product yields were then calculated and the results reported in Table 4.

The second delayed coking test was performed at Pittsburgh Applied Research Corporation (PARC) and was performed in a manner and facility similar to that described above. The feedstocks described above were processed through a feed tank and pump before combining the feedstock with nitrogen in an amount equal to about 2 percent by weight of the feed. The mixture of feedstock and nitrogen was directed to a preheater for heating the mixture to the delayed coking conditions described above, prior to conveying the mixture to the upflow delayed coking drum. The overhead product of the coking drum was condensed and collected in a primary and a secondary condenser and collected in a primary separator. The liquid product collected in the primary separator was drained and weighed every hour. The light gases were conveyed through a wet test meter and then to vent. A slip stream of the light gas was directed to an on-line gas chromatograph for an hourly characterization of the gas make. At the end of each coking cycle, oil feed was stopped and the drum contents "soaked" for 3 hours at a temperature and pressure to complete coking of the feed and allow reaction by-products to leave the drum. The liquid products were collected and weighed during the soak period. The coke yield was determined by weighing the coke drum liner before and after the coke cycle and by weighing the coke recovered from the coke drum liner. The product yields were then calculated and the results reported in Table 4.

TABLE 4

| | STREAM TO DELAYED COKER | | | | | |
|---|---|---|---|---|---|---|
| | 1 | 1 | 5 | 5 | 6 | 6 |
| | PILOT PLANT PRODUCT YIELDS, WT % | | | | | |
| | AOC | PARC | AOC | PARC | AOC | PARC |
| C4-GAS | 7.2 | 8.1 | 9.2 | 8.3 | 8.6 | 7.6 |
| COKER NAPHTHA ($C5^+$-360° F.) | 2.3 | 3.8 | 8.5 | 8.2 | 7.5 | 10.3 |
| COKER DISTILLATE (360° F.-650° F.) | 21.0 | 22.1 | 18.9 | 19.5 | 25.9 | 26.3 |
| COKER GASOIL (650° $F.^+$) | 54.8 | 56.6 | 38.9 | 41.2 | 42.8 | 43.2 |
| GREEN COKE | 14.7 | 9.4 | 24.5 | 22.8 | 15.2 | 12.7 |
| TOTAL | 100.0 | 100.0 | 100.0 | 100.0 | 100.0 | 100.0 |

The product yields provided by the two delayed coking pilot plants were reasonably consistent. The needle coke yields from the AOC pilot plant were generally higher than the needle coke yields from the PARC pilot plant while the liquid yields were generally reversed.

The hydrotreated FCC DCO of Stream 1 provided the lowest yield of needle coke in both the AOC and PARC pilot plants with substantially higher yields of heavy gas oil boiling at a temperature of greater than 650° F. at atmospheric pressure.

The unhydrotreated mixture of solvent extracted oils and resins from a mixture of hydrotreated vacuum resid from a resid hydrotreating process and unhydrotreated FCC DCO of Stream 5 provided high needle coke yields, generally at the expense of heavy gas oil yield.

The hydrotreated mixture of solvent extracted oils and resins from a mixture of hydrotreated vacuum resid from a resid hydrotreating process and unhydrotreated FCC DCO of Stream 6 provided similar needle coke yields to that of the hydrotreated FCC DCO of Stream 1. However, the additional hydrotreating step resulted in higher yields of light products such as coker distillate (boiling at temperatures ranging from about 360° F. to about 650° F.) and naphtha at the expense of heavy gas oil.

EXAMPLE 5

The green coke produced from the delayed coker pilot plants of Example 4 processing feedstocks from Examples 1, 2, and 3, was analyzed for various compositional properties including weight percent of sulfur, nitrogen, carbon, hydrogen, and ash; the ppm of vanadium, nickel, iron, aluminum, and silicon; and the atomic hydrogen to carbon ratio. The compositional properties are described in Table 5.

TABLE 5

| | STREAM TO DELAYED COKER | | | | | |
|---|---|---|---|---|---|---|
| | 1 | 1 | 5 | 5 | 6 | 6 |
| | PILOT PLANT | | | | | |
| COMPOSITION | AOC | PARC | AOC | PARC | AOC | PARC |
| CARBON, WT % | 95.86 | 95.75 | 92.70 | 92.58 | 93.70 | 94.25 |
| HYDROGEN, WT % | 3.50 | 3.31 | 3.62 | 3.44 | 3.77 | 3.49 |
| NITROGEN, WT % | 0.13 | 0.03 | 0.83 | 0.86 | 0.70 | 0.80 |
| SULFUR, WT % | 0.18 | 0.24 | 1.60 | 1.55 | 0.64 | 0.70 |
| ATOMIC H/C RATIO | 0.438 | 0.415 | 0.469 | 0.446 | 0.483 | 0.444 |
| VOLATILES, WT % | 10.1 | 8.6 | 9.8 | 6.3 | 6.4 | 5.3 |
| ASH, WT % | 0.14 | 0.10 | 0.06 | 0.01 | 0.07 | 0.01 |
| METALS, PPM | | | | | | |
| VANADIUM | 2 | 9 | 2 | 4 | 0.2 | 6 |
| NICKEL | 20 | 15 | 6 | 9 | 10 | 42 |
| IRON | 193 | 81 | 12 | 32 | 78 | 264 |
| ALUMINUM | 37 | 89 | 2 | 119 | 14 | 149 |
| SILICON | 365 | 48 | 294 | 68 | 84 | 25 |

The green coke produced from the hydrotreated FCC DCO of Stream 1 from Example 1 had the highest average weight percentage of carbon. The high percentage of carbon may be attributable to the fact that the hydrotreated FCC DCO feedstock was the most highly aromatic feedstock tested. Hydrotreated FCC DCO also contained the highest percentage of ash and metals which may be attributable to the presence of FCC catalyst solids and fines in the feedstock. Green coke produced from hydrotreated FCC DCO also had the lowest percentage of sulfur and nitrogen by weight (0.21% and 0.08% respectively).

The green coke produced from the unhydrotreated mixture of solvent extracted oils and resins from a mixture of hydrotreated vacuum resid from a resid hydrotreating process and unhydrotreated FCC DCO of Stream 5 from Example 2 comprised higher concentrations of sulfur and nitrogen (1.57% and 0.84% respectively) than the green coke from hydrotreated FCC DCO at the expense of weight percent of carbon and ppm metals.

The green coke produced from the hydrotreated mixture of solvent extracted oils and resins from a mixture of hydrotreated vacuum resid from a resid hydrotreating process and unhydrotreated FCC DCO of Stream 6 described in Example 3 provided sulfur results between the results obtained from the cases described above (0.67% and 0.75% respectively).

EXAMPLE 6

The green needle coke described in Example 5 was calcined and converted to calcined needle coke. Calcination was performed by crushing a representative sample of the green coke to −3 mesh (Tyler). Approximately 1000 grams of crushed green coke was placed in an Inconel sagger with an inverted cover. The sagger was then placed in a vertical furnace and heated from a temperature of less than 200° C. to a temperature of about 850° C. at a heating rate of about 110° C. per hour. Upon reaching 850° C., the sagger was allow to cool and the contents removed and transferred to a graphite bottle. The graphite bottle was calcined in a tube graphitizer, which was preheated to a temperature of about 1250° C., for a period of about 45 minutes. During calcination, the graphitizer was purged with nitrogen. The properties of the calcined needle coke and typical calcined needle coke specifications are provided in Table 6.

Premium and Super Premium quality needle coke described in Table 6. This may have resulted from the relatively higher percentages of ash and solids which can be attendant to FCC DCO.

The delayed coking of the unhydrotreated mixture of solvent extracted oils and resins from a mixture of hydrotreated vacuum resid from a resid hydrotreating process and unhydrotreated FCC DCO produced a needle coke having an average sulfur concentration of 1.54 weight percent, which was above the maximum limit on sulfur concentration in Premium and Super Premium needle coke. Similarly, the dynamic puffing characteristics, expressed as the change in deflection as a percentage of the total length of the plug, was also above the maximum requirements for both Premium and Super Premium quality needle coke described in Table 6. The CTE of the needle coke averaged about $2.1\times10^{-7}$ and was generally within the range specified in Table 6 for the production of both Premium and Super Premium quality needle coke.

The delayed coking of the hydrotreated mixture of solvent extracted oils and resins from a mixture of hydrotreated vacuum resid from a resid hydrotreating process and unhydrotreated FCC DCO produced a needle coke having an average sulfur concentration of 0.67 weight percent and generally meeting the sulfur requirements of Premium and Super Premium quality needle coke. Similarly, the dynamic puffing characteristics, expressed as the change in deflection of a puffing plug as a percentage of the total length of the plug, was also below the maximum requirements for both Premium and Super Premium quality needle coke described in Table 6. The CTE of the needle coke averaged about $1.0\times10^{-7}$ and was generally within the range specified in Table 6 for the production of both Premium and Super Premium quality needle coke.

EXAMPLE 8

A prediction analysis was performed from empirical data and calculations, for a conventional refinery feedstock. A resid solvent extraction process feed comprising 60 percent by volume unhydrotreated FCC DCO having a sulfur concentration of 0.8 percent by weight

TABLE 6

| | STREAM TO DELAYED COKER | | | | | | PREMIUM | SUPER PREMIUM | TYPICAL |
|---|---|---|---|---|---|---|---|---|---|
| | 1 | 1 | 5 | 5 | 6 | 6 | | | |
| | PILOT PLANT | | | | | | | | |
| COMPOSITION | AOC | PARC | AOC | PARC | AOC | PARC | SPECIFICATION | SPECIFICATION | SPECIFICATION |
| SULFUR, WT % | 0.12 | 0.24 | 1.57 | 1.52 | 0.66 | 0.69 | 0.7–1.0 | <0.7 | |
| NITROGEN, WT % | 0.56 | 0.30 | 0.78 | 0.76 | 0.79 | 0.89 | | <0.7 | |
| CTE ($10^{-7}$/°6) | | | | | | | | | |
| CTE @ 0% $FE_2O_3$ | 7.1 | 4.3 | 1.7 | 2.6 | 3.7 | 4.2 | <5 | <3 | |
| CTE @ 2% $FE_2O_3$ | 7.2 | 3.6 | 4.2 | 5.0 | 3.2 | 4.5 | <5 | <3 | |
| ΔCTE | +0.1 | −0.7 | +2.5 | +2.4 | −0.5 | +0.3 | | | <2 |
| DYNAMIC PUFFING, % ΔL | | | | | | | | | |
| DP @ 0% $Fe_2O_3$ | | −1.4 | +6.1 | +6.2 | +0.7 | +1.4 | | | <2 |
| DP @ 2% $Fe_2O_3$ | | −1.3 | −0.8 | +0.2 | −1.1 | −1.1 | | | <2 |

The delayed coking of hydrotreated FCC DCO produced a needle coke having an average sulfur concentration of 0.18 weight percent, which is far below the general specifications for Premium and Super Premium quality needle coke. Similarly, the dynamic puffing characteristics, expressed as the change in deflection of a puffing plug as a percentage of the total length of the plug, was far below the requirements of Premium and Super Premium quality needle coke. The CTE of the needle coke, however, averaged about $5.6\times10^{-7}$, which generally does not meet the requirements of and 40 percent by volume hydrotreated vacuum resid from a resid hydrotreating process having a sulfur concentration of 1.5 percent by weight was prepared for processing in a resid solvent extraction process. The combined feedstock had a sulfur concentration of about 1.08 weight percent.

The feedstock was processed in a two-stage resid solvent extraction process at resid solvent extraction process conditions in accordance with the present invention described hereabove. The resid solvent extraction process was operated in a manner so as to produce a 50 percent by weight yield of deasphalted oils and resins.

Figure 2:
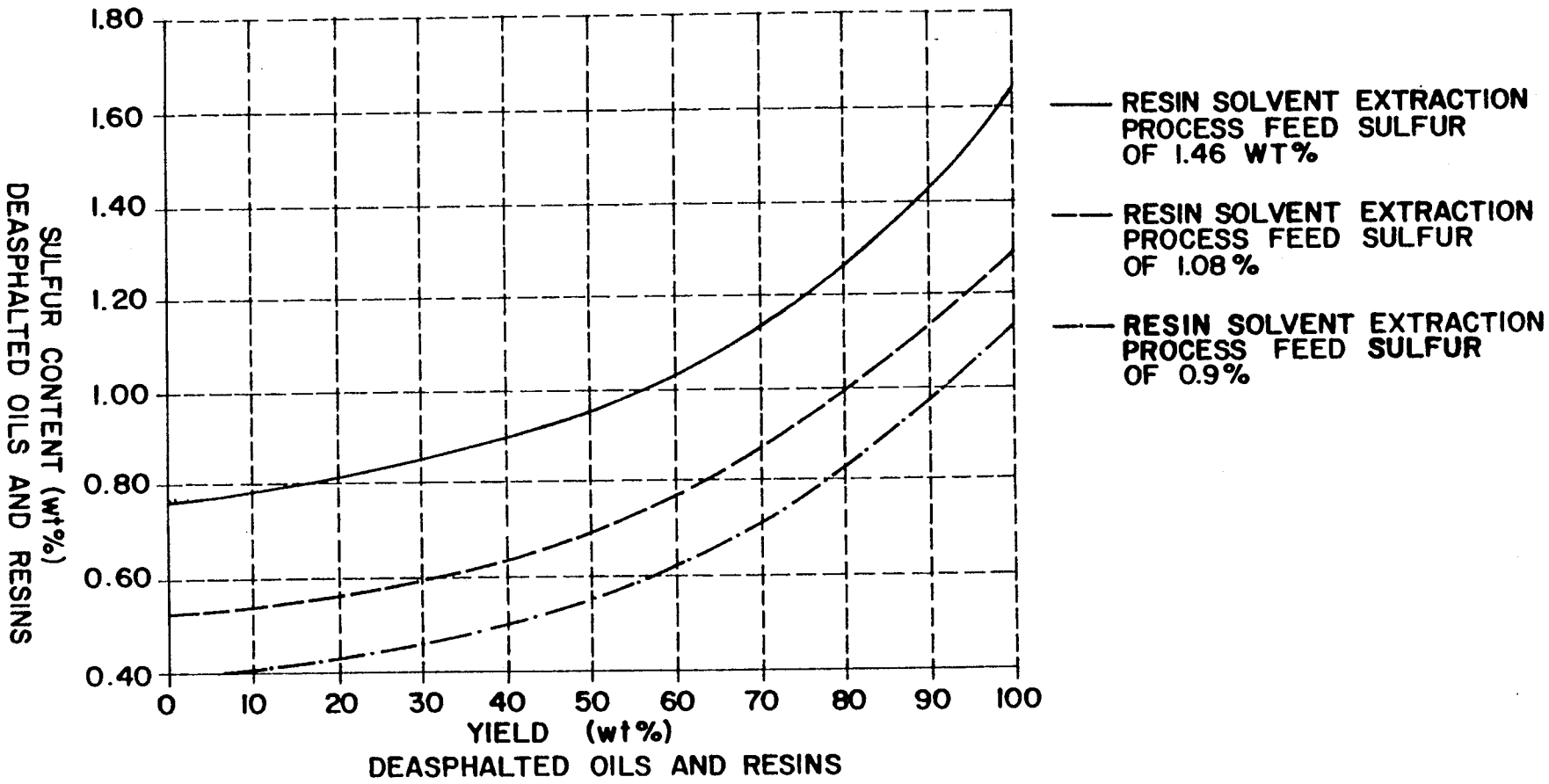
FIG. 2 is a graph which illustrates the relationship between the sulfur concentration of deasphalted oils and resins and the yield of deasphalted oils and resins produced in a resid solvent extraction process for a feedstock comprising a particular blend of FCC DCO and hydrotreated vacuum resid at varying feedstock sulfur concentrations.

FIG. 2 illustrates an empirical correlation between deasphalted oils and resins sulfur concentration as a function of deasphalted oils and resins yield by weight as a fraction of feed, for various feedstock sulfur concentrations and a 60:40 volume mix of FCC DCO and hydrotreated vacuum resid. For a feedstock comprising a 60:40 mix of FCC DCO and hydrotreated vacuum resid at a sulfur concentration of 1.08 percent by weight and a deasphalted oils and resins yield of 50 percent by weight, the correlation predicts a deasphalted oils and resins sulfur concentration of 0.7 percent by weight.

The deasphalted oil from the resid solvent extraction process step was directed to a delayed coking process for coking at delayed coking conditions in accordance with the present invention described hereabove. The properties of the needle coke were estimated empirically from prior data presented in Tables 5 and 6. Extrapolating from the data presented in Tables 5 and 6, there was a near 1:1 correlation between needle coker feed sulfur by weight and needle coke sulfur concentration, resulting in a predicted sulfur concentration of 0.7 percent by weight for the predicted case. The dynamic puffing characteristics were estimated from analysis of a similar concentration of FCC DCO and hydrotreated vacuum resid having a sulfur concentration of about 0.7 weight percent found in Table 4. Based on Table 6, the dynamic puffing characteristics were determined to be about 1.1, expressed as the change in deflection of a puffing plug as a percentage of the total length of the puffing plug. The CTE was also estimated from analysis of a similar concentration of FCC DCO and hydrotreated vacuum resid having a sulfur concentration of 0.7 weight percent found in Table 6. Based on Table 6, the CTE was determined to be about $3.9\times10^{-7}$. The properties of sulfur concentration, dynamic puffing, and CTE for the needle coke predicted from a process for manufacture in accordance with the present invention, met all of the specifications of Super Premium needle coke described in Table 6.

EXAMPLE 9

A second prediction analysis was performed from empirical data and calculations, for a conventional refinery feedstock having a lower combined sulfur concentration. A resid solvent extraction process feed comprising 60 percent by volume unhydrotreated FCC DCO having a sulfur concentration of 0.8 percent by weight and 40 percent by volume hydrotreated vacuum resid from a resid hydrotreating process having a sulfur concentration of 1.1 percent by weight was prepared for processing in a resid solvent extraction process. The combined feedstock had a sulfur concentration of about 0.9 weight percent.

The feedstock was processed in a two-stage resid solvent extraction process at resid solvent extraction process conditions in accordance with the present invention described hereabove. The resid solvent extraction process was operated in a manner so as to produce a 70 percent by weight yield of deasphalted oils and resins.

FIG. 2 illustrates an empirical correlation between deasphalted oils and resins sulfur concentration as a function of deasphalted oils and resins yield by weight as a fraction of feed, for various feedstock sulfur concentrations and a 60:40 volume mix of FCC DCO and hydrotreated vacuum resid. For a feedstock comprising a 60:40 mix of FCC DCO and hydrotreated vacuum resid at a combined sulfur concentration of 0.9 percent by weight and a deasphalted oils and resins yield of 70 percent by weight, the correlation predicts a deasphalted oils and resins sulfur concentration of 0.7 percent by weight.

The deasphalted oil from the resid solvent extraction process step was directed to a delayed coking process for coking at delayed coking conditions in accordance with the present invention described hereabove. The properties of the needle coke were estimated empirically from prior data presented in Tables 5 and 6. Extrapolating from the data presented in Tables 5 and 6, there was a near 1:1 correlation between needle coker feed sulfur by weight and needle coke sulfur concentration resulting in a predicted sulfur concentration of 0.7 percent by weight for the predicted case. The dynamic puffing characteristics were estimated from analysis of a similar concentration of FCC DCO and hydrotreated vacuum resid having a sulfur concentration of about 0.7 weight percent found in Table 6. Based on Table 6, the dynamic puffing characteristics were determined to be about 1.1, expressed as the change in deflection of a puffing plug as a percentage of the total length of the puffing plug. The CTE was also estimated from analysis of a similar concentration of FCC DCO and hydrotreated vacuum resid having a sulfur concentration of 0.7 weight percent found in Table 6. Based on Table 6, the CTE was determined to be about $3.9\times10^{-7}$. The properties of sulfur concentration, dynamic puffing, and CTE for the needle coke predicted from a process for manufacture in accordance with the present invention, met all of the specifications of Super Premium needle coke described in Table 6.

The second predictive analysis illustrates that a process in accordance with the present invention can produce Super Premium needle coke at various ranges of feedstock sulfur concentrations and resid solvent extraction process yields by modifying the feedstock or resid solvent extraction process operation in accordance with the present invention.

Other embodiments of the invention will be apparent to those skilled in the art from a consideration of this specification or from practice of the invention disclosed herein. It is intended that this specification be considered as exemplary only with the true scope and spirit of the invention being indicated by the following claims.

That which is claimed is:

1. A process for producing needle coke comprising the steps of:

passing a heavy resid feedstock to a resid hydrotreating reaction zone at resid hydrotreating conditions and producing light resid hydrotreated products and a heavy resid hydrotreated residual product;

directing said heavy resid hydrotreated residual product and FCC decanted oil to a solvent extraction process reaction zone at solvent extraction process conditions and producing products comprising a solvent extracted oil and resin stream and a stream comprising asphaltenes; and conveying at least a portion of said solvent extracted oil and resin stream to a delayed coking process at delayed coking conditions and producing liquid products and needle coke.

2. The process of claim 1 wherein said heavy resid feedstock comprises at least one member selected from the group consisting of high sulfur resid, low sulfur resid, FCC decanted oil, solvent extracted oil and resin, solvent extracted oil, solvent extracted resin, and lubricating oil solvent extraction process extracts.

3. The process of claim 1 wherein said solvent extracted oil and resin stream is further separated into products comprising a solvent extracted oil stream and a solvent extracted resin stream.

4. The process of claim 3 wherein at least a portion of said solvent extracted resin stream is directed to said resid hydrotreating reaction zone.

5. The process of claim 4 wherein said solvent extracted resin stream is directed to said resid hydrotreating reaction zone in a manner so as to maintain said oil and resin stream at a sulfur concentration range of between about 0.01 percent by weight and about 1.0 percent by weight.

6. The process of claim 3 wherein said separation is performed using at least one separation method selected from the group consisting of solvent extraction and distillation.

7. The process of claim 1 wherein at least a portion of said solvent extracted oil and resin stream is directed to a hydrotreating process for hydrotreating under hydrotreating conditions in the presence of a hydrotreating catalyst prior to processing in said delayed coking process.

8. The process of claim 1 wherein said solvent extracted oil and resin stream comprises an aromatics concentration ranging from about 40 percent by weight to about 90 percent by weight, a sulfur concentration ranging from about 0.1 percent by weight to about 1.0 percent by weight, and an ash concentration ranging from about 0.001 percent by weight to about 0.10 percent by weight.

9. The process of claim 1 wherein said FCC decanted oil flow rate to said solvent extraction process reaction zone is controlled in a manner so as to maintain said solvent extracted oil and resin stream at an aromatics concentration range of between about 30 percent by weight and about 85 percent by weight.

10. A process for producing premium grade coke comprising the steps of:

passing a heavy resid feedstock comprising at least one member selected from the group consisting of high sulfur resid, low sulfur resid, FCC decanted oil, solvent extracted oil and resin, solvent extracted oil, solvent extracted resin, and lubricating oil solvent extraction process extracts to a resid hydrotreating reaction zone at resid hydrotreating conditions and producing light resid hydrotreated products and a heavy resid hydrotreated residual product;

directing said heavy resid hydrotreated residual product and FCC decanted oil to a solvent extraction process reaction zone at solvent extraction process conditions and producing products comprising a solvent extracted oil stream, a solvent extracted resin stream, and a stream comprising asphaltenes; and conveying at least a portion of one or both of said solvent extracted oil stream and said solvent extracted resin stream to delayed coker feedstock for directing to a delayed coking process at delayed coking conditions and producing liquid products and premium grade coke;

wherein said FCC decanted oil is added to at least one or both of said resid hydrotreating reaction zone and said solvent extraction process zone in a manner so as to produce a premium grade coke having a coefficient of thermal expansion of less than about $5\times10^{-7}/°C$.

11. The process of claim 10 wherein at least a portion of said solvent extracted resin stream is directed to said resid hydrotreating reaction zone.

12. The process of claim 11 wherein after directing at least a portion of said solvent extracted resin stream to said resid hydrotreating reaction zone, the remaining solvent extracted resin stream along with the solvent extracted oil stream are combined to form a recombined solvent extracted oil and resin stream.

13. The process of claim 12 wherein said FCC decanted oil flow rate to at least one location of said resid hydrotreating reaction zone and said solvent extraction process reaction zone is controlled in a manner so as to maintain said recombined solvent extracted oil and resin stream at an aromatics concentration range of between about 50 percent by weight and about 80 percent by weight.

14. The process of claim 12 wherein said solvent extracted resin stream is directed to said resid hydrotreating reaction zone in a manner so as to maintain said recombined solvent extracted oil and resin stream at a sulfur concentration range of between about 0.01 percent by weight and about 0.7 percent by weight.

15. The process of claim 14 wherein said solvent extracted resin stream is directed to said resid hydrotreating reaction zone in a manner so as to provide for a premium grade coke having dynamic puffing characteristics of less than 2 percent, expressed as the change in deflection of a puffing plug as a percentage of the total length of the plug.

16. The process of claim 13 wherein said FCC decanted oil flow rate to at least one location of said resid hydrotreating reaction zone and said solvent extraction process reaction zone is controlled in a manner so as to provide for a super premium grade coke having a coefficient of thermal expansion of less than about $3\times10^{-7}/°C$.

17. The process of claim 10 wherein at least a portion of one or both of said solvent extracted oil stream and said solvent extracted resin stream is directed to a hydrotreating process for hydrotreating at hydrotreating conditions in the presence of a hydrotreating catalyst prior to processing in said delayed coking process.

18. The process of claim 10 wherein said delayed coker feedstock comprises an aromatics concentration ranging from about 50 percent by weight to about 80 percent by weight, a sulfur concentration ranging from about 0.1 percent by weight to about 0.7 percent by weight, and an ash concentration ranging from about 0.001 percent by weight to about 0.10 percent by weight.

19. The process of claim 10 wherein said stream comprising asphaltenes is solvent extracted from said heavy resid hydrotreated residual product and FCC decanted oil, leaving a solvent extracted oil stream and a solvent extracted resin stream, and said solvent extracted oil stream is subsequently separated from said solvent extracted resin stream in a distillation step.

20. The process of claim 10 wherein said solvent extraction process conditions comprise the use of at least one solvent selected from the group consisting of propane and isobutane.

* * * * *

UNITED STATES PATENT AND TRADEMARK OFFICE
CERTIFICATE OF CORRECTION

PATENT NO.: 5,286,371

DATED: February 15, 1994

INVENTOR(S): Shri K. Goyal; Jeffrey J. Kolstad; F. W. Hauschildt; Dean G. Venardos; Cheryl L. M. Joyal It is certified that error appears in the above-identified patent and that said Letters Patent is hereby corrected as shown below:

On the title page, item (19) should read --Goyal et al. --

On the title page, item (75) inventor's should read --Cheryl L.M. Joyal --

Signed and Sealed this

Nineteenth Day of July, 1994

Bruce Lehman

*Attest:*

BRUCE LEHMAN

*Attesting Officer*

*Commissioner of Patents and Trademarks*